US008833691B1

(12) United States Patent
Zosimadis

(10) Patent No.: US 8,833,691 B1
(45) Date of Patent: Sep. 16, 2014

(54) PRODUCT, DISPENSER AND METHOD OF DISPENSING PRODUCT

(75) Inventor: Panagiotis Zosimadis, Brampton (CA)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 853 days.

(21) Appl. No.: 12/884,788

(22) Filed: Sep. 17, 2010

Related U.S. Application Data

(63) Continuation-in-part of application No. 12/437,839, filed on May 8, 2009, which is a continuation-in-part of application No. 12/339,888, filed on Dec. 19, 2008.

(60) Provisional application No. 61/015,691, filed on Dec. 21, 2007.

(51) Int. Cl.
*B65H 43/00* (2006.01)

(52) U.S. Cl.
USPC ..... 242/563.2; 242/564.1; 242/565

(58) Field of Classification Search
USPC ..... 242/564, 564.1, 564.2, 563, 564.3, 242/564.4, 565, 563.1, 563.2; 235/462.01, 235/462.13, 454, 470
See application file for complete search history.

(56) References Cited

U.S. PATENT DOCUMENTS

| | | | |
|---|---|---|---|
| 2,259,586 | A | 10/1941 | Ross |
| 3,133,466 | A | 5/1964 | Siefert |
| 3,412,245 | A | 11/1968 | Halverson |
| 3,582,623 | A | 6/1971 | Rothery |
| 3,628,743 | A | 12/1971 | Bastian et al. |
| 3,866,056 | A | 2/1975 | Minniear et al. |
| 4,067,509 | A | 1/1978 | Graham, Jr. et al. |
| 4,260,117 | A | 4/1981 | Perrin et al. |
| 4,282,431 | A | 8/1981 | Anthony, Jr. et al. |
| 4,308,455 | A | 12/1981 | Bullis et al. |
| 4,378,912 | A | 4/1983 | Perrin et al. |

(Continued)

FOREIGN PATENT DOCUMENTS

| | | | |
|---|---|---|---|
| DE | 10115200 | A1 | 10/2002 |
| EP | 1297770 | A1 | 3/1999 |

(Continued)

OTHER PUBLICATIONS

Office Action for U.S. Appl. No. 12/437,839 mailed Jul. 13, 2012.

(Continued)

*Primary Examiner* — William A Rivera
(74) *Attorney, Agent, or Firm* — Sutherland Asbill & Brennan LLP

(57) ABSTRACT

An electronic sheet product dispenser includes a support for a roll of sheet product having a reference indication, a sensor, a battery, a feed mechanism, and a processor. The sensor is responsive to detect the reference indication on the roll, wherein the reference indication is associated with authorized use of the sheet product in the dispenser. The processor is responsive to executable instructions when executed on the processor for performing the method of: determining whether an unauthorized sheet product is disposed in the dispenser, and enabling an unauthorized roll procedure in response to presence of an unauthorized sheet product being detected; and, in response to receiving a low battery warning of the battery, and conditional on an unauthorized roll procedure being enabled, disabling the unauthorized roll procedure and proceeding with responding to a product dispense request to dispense the sheet product out of the dispenser on command.

27 Claims, 12 Drawing Sheets

(56) References Cited

U.S. PATENT DOCUMENTS

| | | | | |
|---|---|---|---|---|
| 4,463,251 | A | 7/1984 | Koutenen et al. | |
| 5,268,581 | A | 12/1993 | Showalter | |
| 5,294,192 | A | 3/1994 | Omdoll et al. | |
| 5,481,100 | A | 1/1996 | Terauchi | |
| 5,526,973 | A | 6/1996 | Boone | |
| 5,558,302 | A | 9/1996 | Jesperson | |
| 5,758,982 | A | 6/1998 | Yoshida et al. | |
| 5,861,618 | A | 1/1999 | Berson | |
| 5,934,167 | A | 8/1999 | Yamamoto | |
| 6,181,662 | B1 | 1/2001 | Krieger et al. | |
| 6,184,534 | B1 | 2/2001 | Stephany et al. | |
| 6,203,069 | B1 | 3/2001 | Outwater et al. | |
| 6,264,107 | B1 | 7/2001 | Thomas, III et al. | |
| 6,334,587 | B1 | 1/2002 | Roder | |
| 6,354,533 | B1 | 3/2002 | Jespersen | |
| 6,361,079 | B1 | 3/2002 | Kirkman | |
| 6,370,844 | B1 | 4/2002 | Stricker | |
| 6,412,726 | B2 | 7/2002 | Inana et al. | |
| 6,419,136 | B2 | 7/2002 | Formon et al. | |
| 6,536,672 | B1 | 3/2003 | Outwater | |
| 6,556,690 | B1 | 4/2003 | Nelson | |
| 6,592,067 | B2 | 7/2003 | Denen et al. | |
| 6,766,977 | B2 | 7/2004 | Denen et al. | |
| 6,819,243 | B2 | 11/2004 | Keskilammi | |
| 6,820,785 | B2 | 11/2004 | Kapiloff | |
| 6,826,985 | B2 | 12/2004 | Bruehl | |
| 6,826,991 | B1 | 12/2004 | Rasmussen | |
| 6,854,684 | B2 | 2/2005 | Byrd et al. | |
| 6,892,620 | B2 | 5/2005 | Kapiloff | |
| 6,894,711 | B2 | 5/2005 | Yamakawa et al. | |
| 6,903,654 | B2 | 6/2005 | Hansen et al. | |
| 6,962,451 | B2 | 11/2005 | Narita et al. | |
| 6,977,588 | B2 | 12/2005 | Schotz et al. | |
| 7,038,587 | B2 | 5/2006 | Bellum et al. | |
| 7,040,566 | B1 | 5/2006 | Rodrian et al. | |
| 7,184,569 | B2 | 2/2007 | Lawandy et al. | |
| 7,237,744 | B2 | 7/2007 | Morris et al. | |
| 7,242,307 | B1 | 7/2007 | LeBlond et al. | |
| 7,256,398 | B2 | 8/2007 | Ross et al. | |
| 7,270,292 | B2 | 9/2007 | Rasmussen | |
| 7,378,675 | B2 | 5/2008 | Ross et al. | |
| 7,427,030 | B2 | 9/2008 | Jones et al. | |
| 7,441,704 | B2 | 10/2008 | Ross | |
| 7,533,845 | B2 * | 5/2009 | Neveu et al. | 242/563 |
| 7,774,096 | B2 | 8/2010 | Goerg et al. | |
| 7,783,380 | B2 | 8/2010 | York et al. | |
| 8,160,742 | B2 * | 4/2012 | Goerg et al. | 700/240 |
| 8,165,716 | B1 | 4/2012 | Goeking et al. | |
| 8,511,598 | B2 * | 8/2013 | Neveu et al. | 242/563 |
| 8,544,785 | B2 * | 10/2013 | Pelland et al. | 242/563 |
| 2001/0050320 | A1 | 12/2001 | Inana et al. | |
| 2002/0109036 | A1 * | 8/2002 | Denen et al. | 242/560 |
| 2002/0117578 | A1 | 8/2002 | Denen et al. | |
| 2002/0132093 | A1 | 9/2002 | Martin et al. | |
| 2003/0168489 | A1 | 9/2003 | Formon et al. | |
| 2003/0177850 | A1 | 9/2003 | Whittington | |
| 2003/0189125 | A1 | 10/2003 | Trierenberg | |
| 2004/0031931 | A1 | 2/2004 | Muller et al. | |
| 2004/0043248 | A1 | 3/2004 | Bharti | |
| 2004/0099678 | A1 | 5/2004 | Windorski et al. | |
| 2005/0011987 | A1 | 1/2005 | Lemaire et al. | |
| 2005/0145745 | A1 | 7/2005 | Lewis et al. | |
| 2005/0167541 | A1 | 8/2005 | Osborne | |
| 2005/0171634 | A1 | 8/2005 | York et al. | |
| 2005/0178841 | A1 | 8/2005 | Jones, II et al. | |
| 2005/0198920 | A1 | 9/2005 | Nakagawa et al. | |
| 2005/0220462 | A1 | 10/2005 | Miyaji | |
| 2005/0237200 | A1 | 10/2005 | Bellum et al. | |
| 2006/0006275 | A1 | 1/2006 | Neveu et al. | |
| 2006/0024115 | A1 | 2/2006 | Komatsu | |
| 2006/0053068 | A1 | 3/2006 | Gretsch | |
| 2006/0065670 | A1 | 3/2006 | Doublet et al. | |
| 2006/0102774 | A1 | 5/2006 | Quick | |
| 2006/0173576 | A1 | 8/2006 | Goerg et al. | |
| 2007/0251849 | A1 | 11/2007 | Lo et al. | |
| 2007/0256136 | A1 | 11/2007 | Simske et al. | |
| 2008/0029590 | A1 | 2/2008 | Zosmidas | |
| 2008/0048064 | A1 | 2/2008 | Lemaire et al. | |
| 2008/0121815 | A1 | 5/2008 | Agrawal et al. | |
| 2009/0250484 | A1 | 10/2009 | Kling et al. | |
| 2010/0030376 | A1 | 2/2010 | Omdoll | |
| 2010/0146587 | A1 | 6/2010 | Sholes et al. | |
| 2011/0114782 | A1 | 5/2011 | Rodrian et al. | |
| 2011/0133019 | A1 * | 6/2011 | Keily et al. | 242/564 |

FOREIGN PATENT DOCUMENTS

| | | | |
|---|---|---|---|
| KR | 2007525258 | A | 9/2007 |
| WO | 99/50788 | A1 | 10/1999 |
| WO | 2006/011881 | A1 | 2/2006 |
| WO | 2007/120858 | A1 | 10/2007 |
| WO | 2009/055473 | A1 | 4/2009 |

OTHER PUBLICATIONS

State Intellectual Property Office of the People's Republic of China Office Action for Application No. 200880118827.5 dated Mar. 12, 2012.

Eurasian Patent Office Official Notification for Application No. 201070785 dated Feb. 21, 2012.

State Intellectual Property Office of the People's Republic of China Office Action for Application No. 200880118827.5 dated Aug. 31, 2012.

Non-Final Office Action for U.S. Appl. No. 12/437,839 mailed Feb. 6, 2012.

International Search Report and Written Opinion of the International Searching Authority for PCT/US2008/08773 mailed Mar. 30, 2008.

Definition of "unauthorized" from dictionary.com http://dictionary.reference.com/browse/unauthorized; date printed Dec. 29, 2010.

Definition of "unrecognized" from dictionary.com http://dictionary.reference.com/browse/unrecognized; date printed Dec. 29, 2010.

Office Actions for U.S. Appl. No. 12/339,888.

Office Actions for U.S. Appl. No. 12/636,047.

Final Office Action for U.S. Appl. No. 12/339,888 mailed Oct. 18, 2011.

Final Office Action for U.S. Appl. No. 12/636,047 mailed Oct. 6, 2011.

First Office Action for Chinese Application No. 200880118827.5 mailed May 5, 2011.

Office Action for U.S. Appl. No. 12/339,888 mailed Dec. 15, 2010.

Office Action for U.S. Appl. No. 12/339,888 mailed Mar. 21, 2011.

Office Action for U.S. Appl. No. 12/339,888 mailed Jan. 14, 2014.

Office Action for U.S. Appl. No. 12/437,839 mailed Feb. 6, 2012.

Office Action for U.S. Appl. No. 12/437,839 mailed Jun. 5, 2013.

Office Action for U.S. Appl. No. 12/437,839 mailed Jul. 5, 2013.

Office Action for U.S. Appl. No. 12/437,839 mailed Sep. 30, 2013.

Office Action for U.S. Appl. No. 12/437,839 mailed Dec. 5, 2013.

Office Action for U.S. Appl. No. 12/636,047 mailed Dec. 16, 2010.

Office Action for U.S. Appl. No. 12/636,047 mailed Mar. 18, 2011.

* cited by examiner

PRODUCT, DISPENSER AND METHOD OF DISPENSING PRODUCT

CROSS-REFERENCE TO RELATED APPLICATION

This application is a continuation in part of U.S. patent application Ser. No. 12/437,839 filed May 8, 2009, which is a continuation in part of U.S. patent application Ser. No. 12/339,888 filed on Dec. 19, 2008, which claims priority to U.S. Provisional Application No. 61/015,691 filed Dec. 21, 2007, all of which are herein incorporated by reference in their entirety.

BACKGROUND OF THE INVENTION

The present disclosure relates generally to dispensers, and more specifically to dispensers that discourage the use of unauthorized sheet product.

Dispenser apparatus for dispensing flexible sheet product, such as paper towel and the like, are well known in the art. Such dispensers typically discharge sheet product provided in the form of a sheet product roll. The sheet product roll comprises a sheet product web wound about a core. The core is typically in the form of a cylindrically-shaped hollow core made of paper, plastic or a like material. The core typically has an inner surface and open ends provided to mount the sheet product roll within the dispenser. The sheet product roll may be mounted within the dispenser, for example, by means of a yoke with roll holders or mandrels adapted for insertion into the open ends of the core.

Dispensers presently commercially generally available lack any capability to identify whether a product is authorized for use with such dispensers. The use of unauthorized sheet product in a proprietary dispenser can contribute to unreliable operation of the dispenser. The practice of supplying unauthorized paper to a proprietary dispenser is sometimes referred to in the art as "stuffing". One proposed method of addressing this problem of unauthorized sheet product use in a dispenser has been to provide a dispenser permitting recognition of sheet product for use with a given dispenser and "locking-out" (e.g., disabling) the dispenser when unauthorized sheet product is employed. One problem of "lock-out" schemes is that they disable the dispenser, thereby giving the appearance of unreliability of the dispenser to the end user.

Accordingly, while existing sheet product dispensers are suitable for their intended purposes, a continual need for improvement exists for dispensers that discourage the use of unauthorized product.

BRIEF DESCRIPTION OF THE INVENTION

Disclosed herein are products, dispensers and methods of dispensing products.

In one embodiment, a method of dispensing product is provided. The method includes exciting a pigment in a reference indication with first light. A second light is emitted with the pigment. A first light intensity is measured of the second light at a first time. A second light intensity is measured of the second light at second time. A change in light intensity is calculated from the first time to the second time. The change in light intensity is compared to a predetermined value.

In another embodiment, another method of dispensing a product is provided. The method includes the step of calculating an expected number of reference indications. The number reference indications is counted while the product is dispensed. The number of counted reference indications is compared to a parameter. It is determined from the comparison if a first core from an authorized product has been inserted into a second core of an unauthorized product.

In one embodiment, a sheet product is provided. The sheet product includes a core. A sheet product web is wound about the core. Wherein the core includes at least one reference indication containing a phosphorescent pigment having a defined intensity signature.

In another embodiment, a sheet product dispenser for dispensing sheet product is provided. The sheet product dispenser includes a support for rotatably supporting a roll. A sensor is responsive to rotation of the roll to detect a first light from a reference indication on a core of the roll, wherein the reference indication being associated with authorized use of the sheet product in the dispenser. A processor is arranged in operable communication with the sensor, wherein the processor is responsive to executable instructions stored on a storage medium, the executable instructions when executed on the processor for performing a method comprising the steps of exciting a pigment in the reference indication with a second light. The first light is emitted with the pigment. A first light intensity is measured of the first light at a first time. A second light intensity is measured of the first light at a second time. A change in light intensity is calculated from the first time to the second time. The change in light intensity is compared to a predetermined value.

In one embodiment, another sheet product dispenser for dispensing sheet product is provided. The sheet product dispenser includes a support for rotatably supporting the roll. A sensor is responsive to rotation of the roll to detect a reference indication on a core of said roll, wherein the reference indication being associated with authorized use of said sheet product in said dispenser. A feed mechanism includes a drive motor and at least one roller, wherein the motor and at least one roller cooperate to advance the sheet product out of the sheet product dispenser. A processor is arranged in operable communication with the sensor and the feed mechanism, wherein the processor is responsive to executable instructions stored on a storage medium, the executable instructions when executed on the processor for performing a method. The method includes the steps of calculating an expected number of reference indications. The number reference indications are counted while the product is dispensed. The number of counted reference indications is compared to a parameter. It is determined from the comparison if a first core from an authorized product has been inserted into an unauthorized product.

In one embodiment, another sheet product dispenser is provided. The sheet product dispenser includes a support sized to receive a core for a sheet product roll. A light emitter is operably coupled to the support, the light emitter arranged to direct a light towards the core. A receiver is operably coupled to the support, the receiver arranged to receive light emitted from the core. A lens is disposed between the receiver and the core, the lens is arranged to focus a light emitted from the roll on the receiver.

An embodiment of the invention includes an electronic sheet product dispenser for dispensing sheet product, the sheet product dispenser having a support disposed for rotatably supporting a roll, a sensor, a battery, a feed mechanism, and a processor. The sensor is responsive to rotation of the roll to detect a reference indication on the roll, wherein the reference indication is associated with authorized use of the sheet product in the dispenser. The feed mechanism is in operative communication with the battery and includes a drive motor and at least one roller, wherein the motor and the at least one roller cooperate to advance the sheet product out of the dispenser. The processor is in operable communication with the battery, the sensor, and the feed mechanism, wherein the processor is responsive to executable instructions stored on a storage medium, the executable instructions when executed on the processor perform the following method: determining whether an unauthorized sheet product is disposed in the dispenser, and enabling an unauthorized roll procedure in response to presence of an unauthorized sheet product being detected; and, in response to receiving a low battery warning of the battery, and the battery voltage being below a threshold value, and conditional on an unauthorized roll procedure being enabled, disabling the unauthorized roll procedure and proceeding with responding to a product dispense request to dispense the sheet product out of the dispenser on command.

An embodiment of the invention includes a method of controlling product dispensing from an electronic product dispense apparatus operative under battery power and having a processor responsive to a product dispense request, the processor being capable of enabling and initiating an unauthorized roll procedure. The method includes: in response to receiving a low battery warning of a battery operative to provide the battery power to the electronic product dispense apparatus, determining whether an unauthorized roll procedure is enabled; and in response to an unauthorized roll procedure being enabled and a voltage of the battery being below a threshold value, disabling the unauthorized roll procedure and proceeding with responding to the product dispense request.

An embodiment of the invention includes an electronic sheet product dispenser for dispensing sheet product. The sheet product dispenser includes a cover openable with respect to a back panel, a support for rotatably supporting a roll of sheet product, a sensor, an indicator, feed mechanism, a manual feed button, and a processor. The sensor is responsive to rotation of the roll to detect a reference indication on the roll, wherein the reference indication is associated with authorized use of the sheet product in the dispenser. The indicator is disposed to provide indication relating to presence of an authorized sheet product being disposed in the dispenser. The feed mechanism is in operative communication with means for receiving electrical power, the feed mechanism having a drive motor and at least one roller, wherein the motor and the at least one roller cooperate to advance the sheet product out of the dispenser. The manual feed button is in operative communication with the feed mechanism to advance the sheet product out of the dispenser in response to the manual feed button being activated. The processor is in operable communication with the means for receiving electrical power, the sensor, the indicator, the feed mechanism, and the manual feed button, wherein the processor is responsive to executable instructions stored on a storage medium, the executable instructions when executed on the processor for performing a method. The method includes: determining whether an authorized or unauthorized sheet product is disposed in the dispenser, enabling an authorized roll procedure in response to presence of an authorized sheet product being detected, and enabling an unauthorized roll procedure in response to presence of an unauthorized sheet product being detected; and, in response to the manual feed button being activated, and conditional on the cover being open, and conditional on an authorized roll procedure being enabled, activating the indicator to provide indication that an authorized sheet product is disposed in the dispenser.

An embodiment of the invention includes a method of controlling product dispensing from an electronic product dispense apparatus. The electronic product dispense apparatus includes a cover openable with respect to a back panel, a manual feed button configured in operative communication with a feed mechanism to advance sheet product out of the electronic product dispense apparatus in response to the manual feed button being activated, an indicator, and a processor being capable of enabling and initiating an authorized roll procedure and an unauthorized roll procedure, and being responsive to activation of the manual feed button. The method includes: determining whether an authorized or an unauthorized roll procedure is enabled; and, in response to the manual feed button being activated, and conditional on the cover being open, and conditional on an authorized roll procedure being enabled, activating the indicator to provide indication that an authorized sheet product is disposed in the dispenser.

An embodiment of the invention includes an electronic sheet product dispenser for dispensing sheet product. The sheet product dispenser includes a support for rotatably supporting a roll of sheet product, a sensor, an indicator, a feed mechanism, a manual feed button, and a processor. The sensor is responsive to rotation of the roll to detect a reference indication on the roll, wherein the reference indication is associated with authorized use of the sheet product in the dispenser. The indicator is disposed to provide indication relating to presence of an authorized sheet product being disposed in the dispenser. The feed mechanism is in operative communication with a means for receiving electrical power, the feed mechanism having a drive motor and at least one roller, wherein the motor and the at least one roller cooperate to advance the sheet product out of the dispenser. The manual feed button is in operative communication with the feed mechanism to advance the sheet product out of the dispenser in response to the manual feed button being activated. The processor is in operable communication with the means for receiving electrical power, the sensor, the indicator, the feed mechanism, and the manual feed button, wherein the processor is responsive to executable instructions stored on a storage medium, the executable instructions when executed on the processor for performing a method. The method includes: determining whether an authorized or unauthorized sheet product is disposed in the dispenser, enabling an authorized roll procedure in response to presence of an authorized sheet product being detected, and enabling an unauthorized roll procedure in response to presence of an unauthorized sheet product being detected; and, in response to the manual feed button being activated, and conditional on an authorized roll procedure being enabled, activating the indicator to provide indication that an authorized sheet product is disposed in the dispenser.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

Disclosed herein are dispensers that that discourage the use of unauthorized products (articles). For ease in discussion, reference is made to the product being a sheet product, with the understanding that a person of skill in the art can readily adapt these teachings to other articles, such as flowable products (e.g., liquids, foams, gases, or gels), cutlery, cups, and the like without undue experimentation.

The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from a roll or folded arrangement at discrete intervals. Individual sheets may be sized as desired to accommodate the many uses of the sheet products. For example, perforation lines may be formed every 13 inches, or other defined interval, to define a universally sized sheet. Multiple perforation lines may be provided to allow the user to select the size of sheet depending on the particular need.

Figure 1:
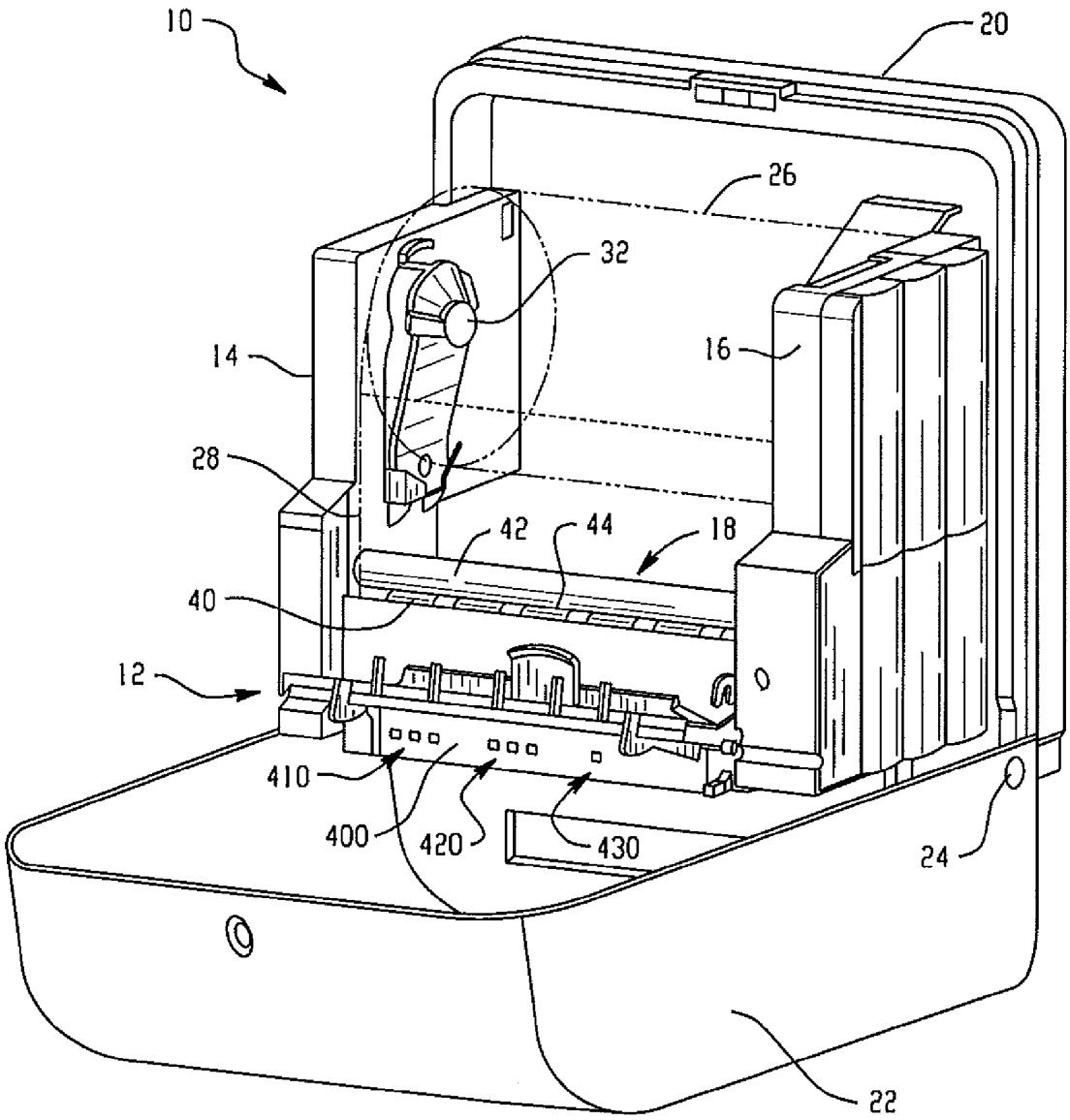
FIG. 1 is a perspective view of a sheet product dispenser in accordance with an embodiment of the invention.
Figure 2:
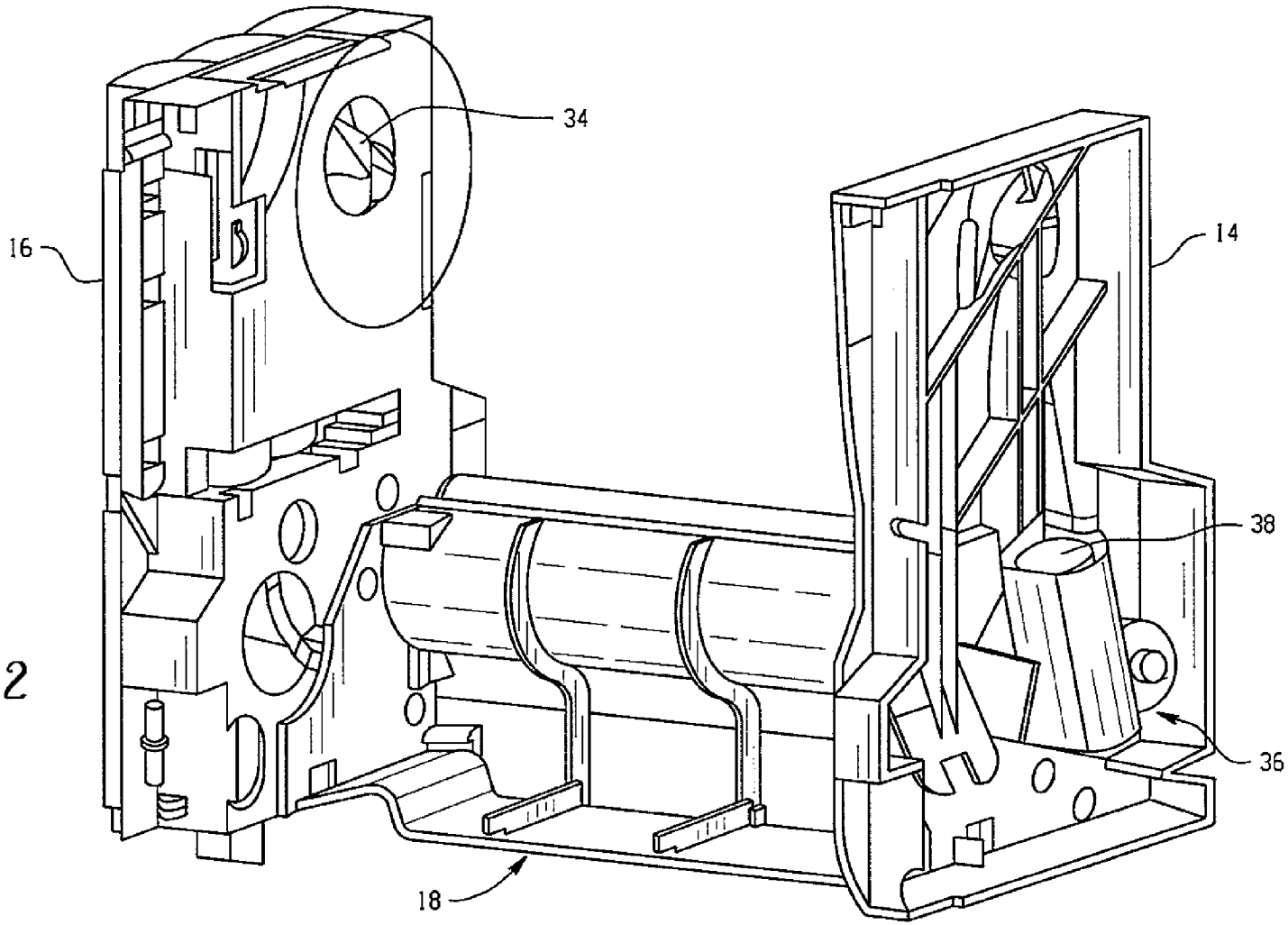
FIG. 2 is a rear side perspective view of a chassis assembly and parts shown in FIG. 1 in accordance with an embodiment of the invention.

Referring to FIGS. 1 and 2, an embodiment of a sheet dispenser 10 adapted to dispense sheet products 28 is depicted. The sheet dispenser 10 includes a chassis assembly 12 that includes a right side chassis member 14, a left side chassis member 16, and a middle chassis member 18 extending between the side chassis members 14, 16. Sheet dispenser 10 further includes a back panel member 20 and a pivotal front cover 22 attached, by a pin 24, hinge or other convenient attachment mechanism, to back panel member 20. Front cover 22 may be opened and pivoted away from chassis assembly 12 to a sheet product loading position (as shown) allowing a roll 26 of sheet product 28 to be loaded into sheet dispenser 10. Roll 26 is rotatably supported between a pair of supports, such as inwardly directed hubs 32, 34 that can be loosely received within the core of the roll 26 to permit free rotation of the roll 26. Of course, numerous other roll mounting arrangements could also be used.

Middle chassis member 18 provides a foundation for a feed mechanism 36, driven by an electric feed motor 38, serving to dispense sheet product 28 from roll 26 in incremental sheet segments. In one embodiment as depicted, the feed mechanism 36 includes a mating feed roller 40 and pressure roller 42 which cooperate to dispense the sheet product 28. Feed roller 40 and pressure roller 42 are mounted upon axles rotatably supported at their ends by side chassis members 14, 16. Pressure roller 42 may be biased against feed roller 40 by a spring (not shown) to define a feed nip 44. When sheet product 28 is fed into feed nip 44, rotation of feed roller 40 causes sheet product 28 to be advanced through feed nip 44, around feed roller 40.

Figure 3:
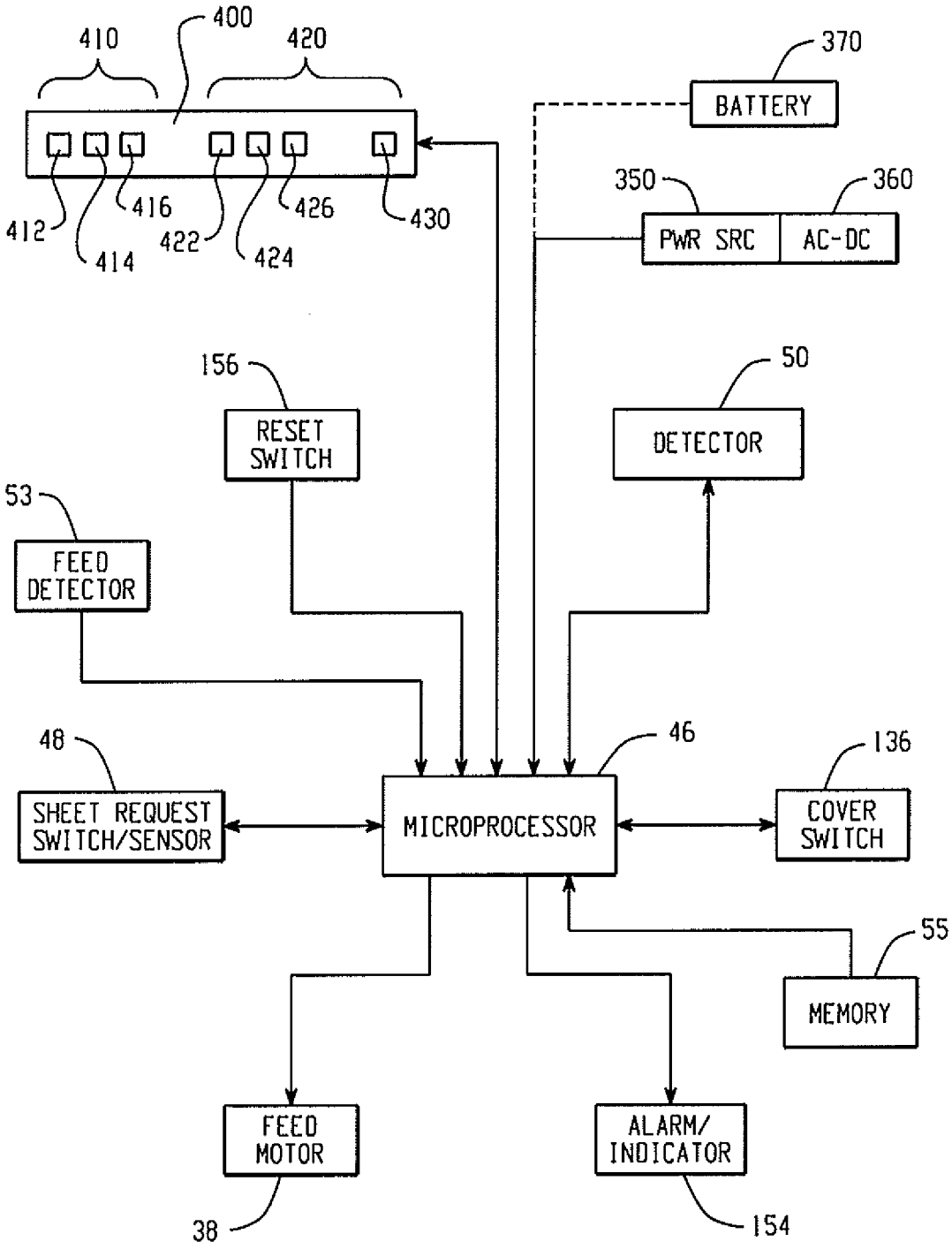
FIG. 3 is a block diagram of an electrical control system that may be implemented in the dispenser of FIG. 1 in accordance with an embodiment of the invention.

FIG. 3 (with periodic reference to FIG. 1) depicts various electrical components of sheet dispenser 10, and their interrelationship with each other. A microprocessor 46 controls sheet dispenser 10 to feed a sheet segment in response to receipt of a signal from a sheet request switch or sensor 48. The microprocessor 46 is a suitable electronic device capable of accepting data and instructions, executing the instructions to process the data, and presenting the results. Microprocessor 46 may accept instructions through user interface, or through other means such as but not limited to electronic data card, voice activation means, manually-operable selection and control means, radiated wavelength and electronic or electrical transfer. Therefore, microprocessor can be a microprocessor, microcomputer, a minicomputer, an optical computer, a board computer, a complex instruction set computer, an ASIC (application specific integrated circuit), a reduced instruction set computer, an analog computer, a digital computer or a hybrid of any of the foregoing.

The various electrical components of sheet dispenser 10 may be powered by an external AC (alternating current) power source 350, such as a 120 VAC 50-60 Hertz wall outlet, for example, with an AC/DC converter 360 for power conditioning, or alternatively may be powered by a DC power source 370, such as a plurality of D-Cell batteries, for example. While FIG. 3 depicts the AC power source 350 and the alternate DC power source 370 in electrical communication with microprocessor 46 only, it will be appreciated that this is for single-line illustration purposes only, where in reality the respective power source 350, 370 is in electrical communication with any or all of the electrical components of sheet dispenser 10 as required for the purposes disclosed herein.

Microprocessor 46 is capable of converting the analog voltage or current level provided by detector 53 into a digital signal indicative of the amount of sheet product dispensed. Alternatively, detector 53 may be configured to provide a digital signal to microprocessor 46, or an analog-to-digital (A/D) converter (not shown) maybe coupled between detector 53 and microprocessor 46 to convert the analog signal provided by detector 53 into a digital signal for processing by microprocessor 46. Microprocessor 46 uses the digital signals act as input to various processes for controlling the sheet dispenser 10.

Microprocessor 46 includes a processor coupled to one or more memory circuits 55. Memory circuits 55 may include, but is not limited to: a random access memory (RAM), non-volatile memory (NVM), and read-only memory (ROM). Memory circuits 55 may also include forms of memory such as an EPROM (Erasable Programmable Read Only Memory) chip, flash memory, optical drives, magnetic disk drives, or the like. Stored in memory circuits 55 are various operational parameters for the application code. In some embodiments, the various operational parameters may be input to memory circuits 55 either locally, using a keypad or remote computer, or remotely via the Internet using remote computer.

Figure 11:
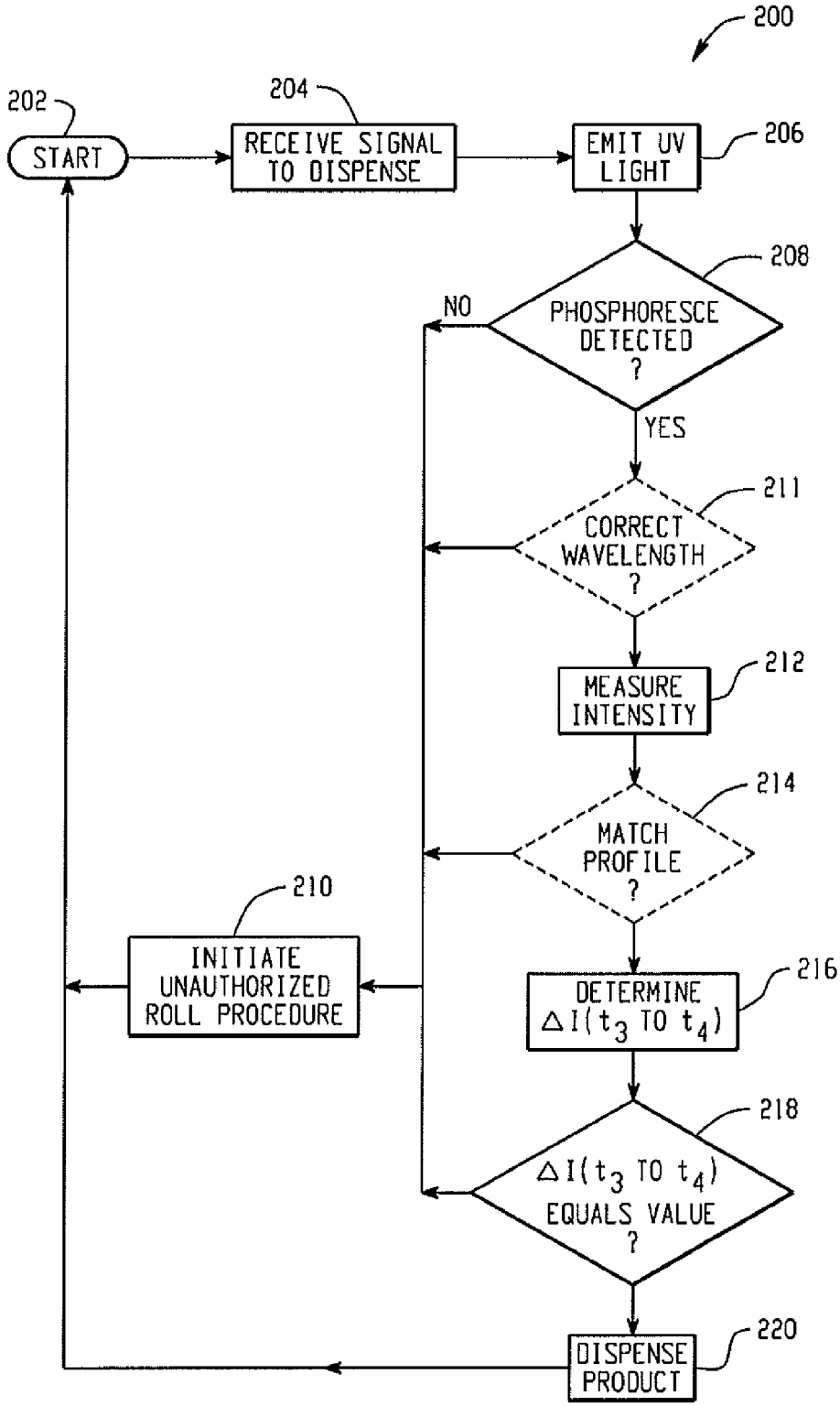
FIG. 11 is a flow diagram of a method of checking the authentication of a product in accordance with an embodiment of the invention.
Figure 12:
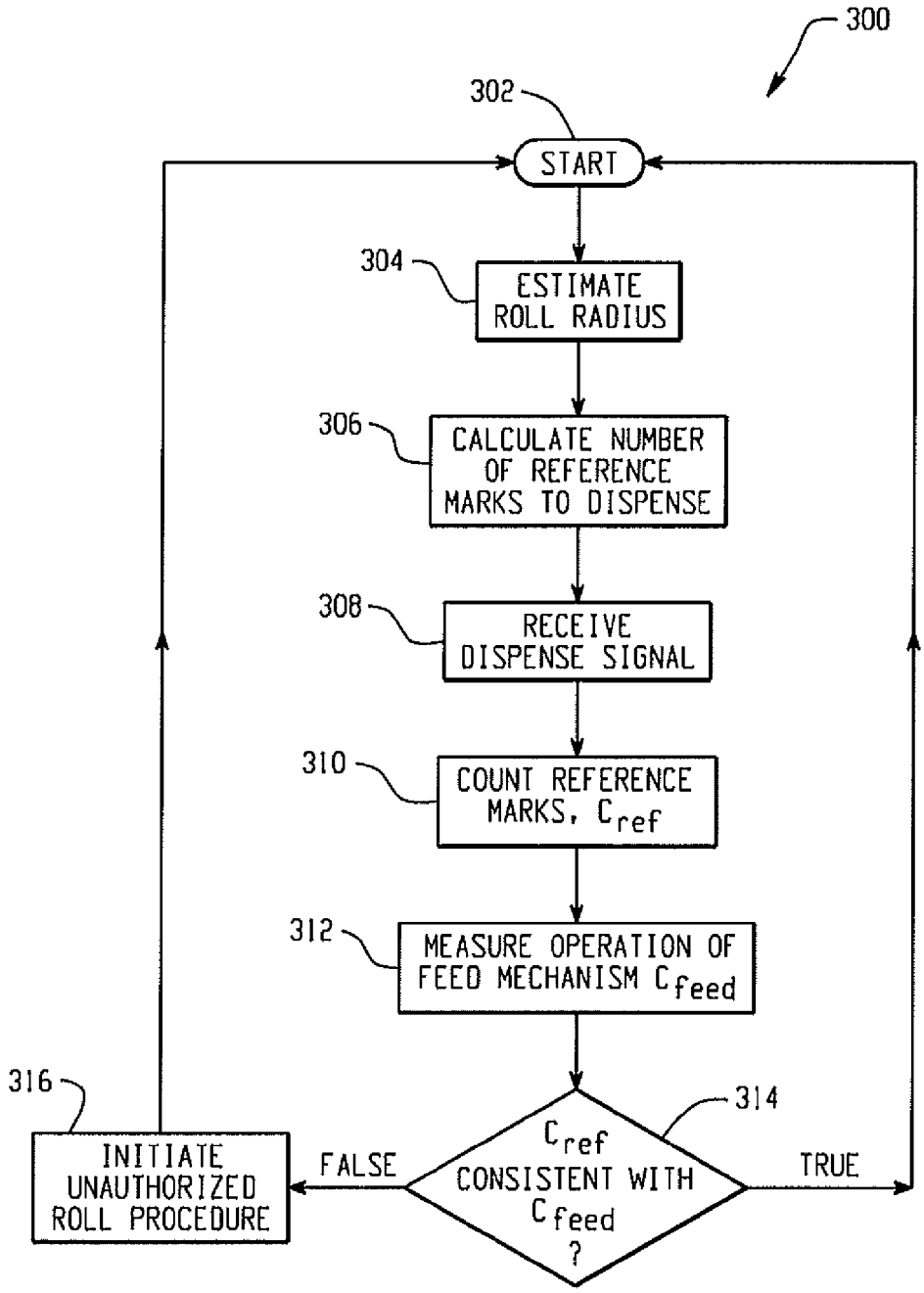
FIG. 12 is another flow diagram of a method of checking the authentication of a product in accordance with an embodiment of the invention.
Figure 13:
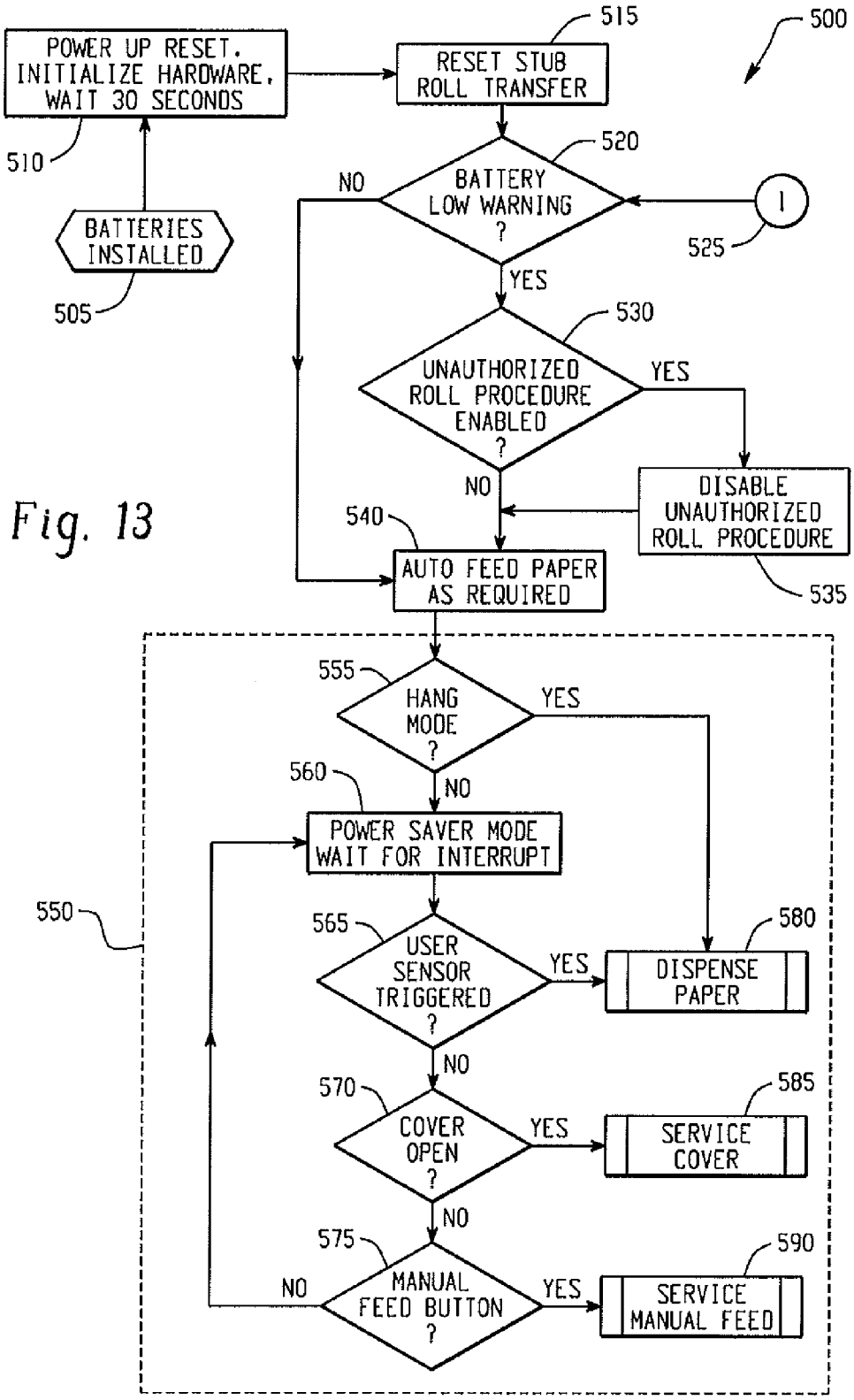
FIG. 13 is a flow diagram of a portion of a method of controlling product dispensing from the dispenser of FIGS. 1-3 in accordance with an embodiment of the invention.

Microprocessor 46 includes operation control methods embodied in application code depicted in flowchart form in FIGS. 11-13. These methods are embodied in computer instructions written to be executed by microprocessor 46, typically in the form of software. The software can be encoded in any language, including, but not limited to, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In the exemplary embodiment, a detector 53 in signal communication with the microprocessor 46 controls the amount, or length of sheet product 28 fed per dispense cycle by controlling feed motor 38. Detector 53 may be a shaft encoder, either electromechanical or optical, mounted to generate a pulse for each small increment of rotation of feed roller 40, the pressure roller 42, or the feed motor 38 for example. In another embodiment, an optical shaft encoder can be mounted on an axle of feed roller 40 to output a pulse train corresponding to rotation of the feed roller 40. The signal generated by the detector 53 provides an indication of the amount of sheet product 28 dispensed. As will be discussed in more detail below, the microprocessor 46 is further coupled to a detector 50. The detector 50 is arranged adjacent to the roll 26 to determine the presence of a reference indication 52 (see for example FIG. 4.).

With reference back to FIG. 3, in addition to receiving input signals from the sheet requests sensor/switch 48, detector (encoder) 53, and cover switch 136, microprocessor 46 may also optionally receive input from a manual reset button 156 effectively serving to return the state of the microprocessor 46 to the initial state assumed upon closure of front cover 22. In one embodiment, the microprocessor 46 may be responsive to loading of such material absent reference indications 52 (FIG. 4) to indicate use of unidentified material by flashing a light emitting diode (LED).

In the illustrated embodiment, roll 26 includes a continuous web of flat segments of sheet product 28 that may be wound upon a hollow cylindrical core. Sheet dispenser 10 could, of course, dispense other flexible sheet products 28. The sheet product 28 could, for example, be in the form of folded sheet segments wound onto a roll and separable from each other along lines of perforation to form folded napkins.

In an exemplary embodiment, the roll 26 includes reference indications 52 (FIG. 4) associated with the sheet product 28 to identify the sheet product 28 as being an "authorized" product for use in the sheet dispenser 10. For example, the reference indications 52 can be disposed on a core of the roll 26 or disposed on the sheet product 28. The term "authorized" is being used to denote that the product or article is sanctioned, or otherwise intended by the dispenser manufacturer, for use in the sheet dispenser 10. For example, the authorized product may refer to branded product that is used in a proprietary sheet dispenser 10; it may refer to permissions give to distributors for given sheet dispensers 10 in a geographical region or channel; and the like.

The reference indications 52 may be visible or invisible to the human eye, but are detectable via a sensor. The sensor employed will vary depending on the choice of reference indications 52. For example, suitable reference indications include, but are not limited, to bar codes; RFID "radio frequency identification" tags; inks or dyes; conductive particles, fibers, or metals; tick marks; ridges.

Figure 7:
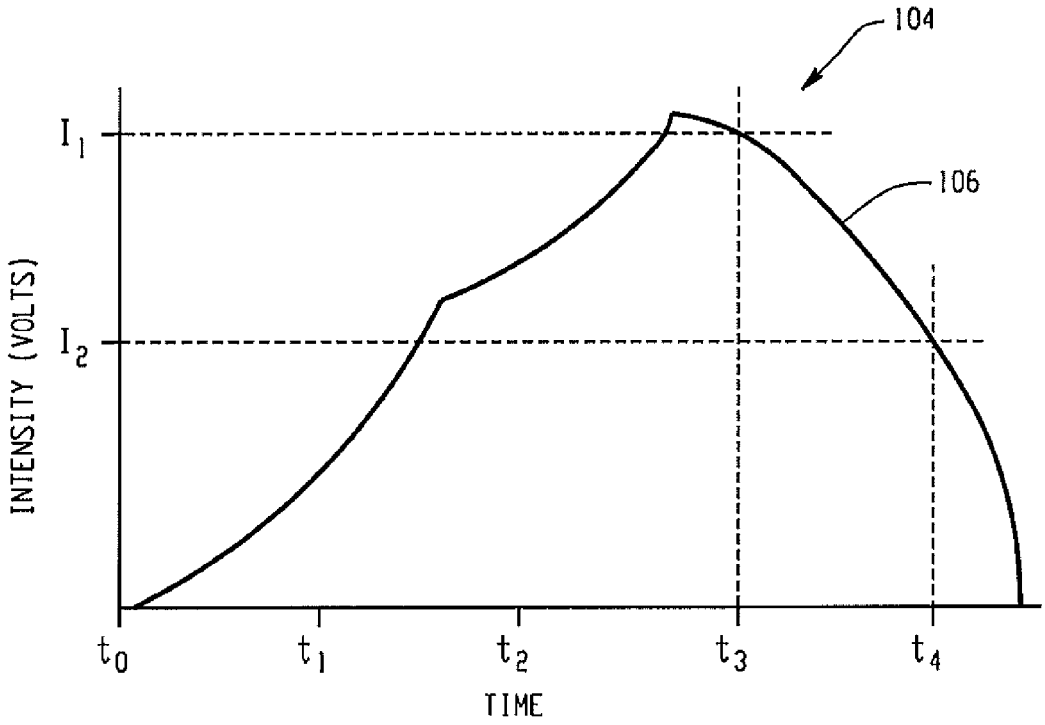
FIG. 7 is a plot of a pigment intensity signature in accordance with an embodiment of the invention.

In the exemplary embodiment, the reference indications 52 are sensitive to optical stimulation in the UV spectrum. In this embodiment, when the optical emitter 100 (FIG. 5) emits one or more UV photons which excite pigments in the reference indication 52. In one embodiment, the reference indication 52 is made from an ink having 8 μm pigments, such as those marketed under the Uveda™ tradename, manufactured by United Mineral & Chemical Corp. The ink may be applied to the roll 26 core using a flexographic printing process for example. As will be discussed in more detail below, once the pigments are excited, the reference indication 52 phosphoresces at a known wavelength with a known and predictable and defined intensity signature as illustrated in FIG. 7.

In another embodiment, the reference indications 52 may include one or more marks that fluoresce when in the presence of light provided from a light source. The light source, detector, and reference indications can all correspond with each other such that these components operate with light of a predetermined wavelength. Unlike the phosphoresce inks of the exemplary embodiment, which continue to emit photons once the stimulation light source is removed, the fluorescence inks will stop emitting once the light is removed. While fluorescence marks may be suitable for many occasions, a sophisticated counterfeiter or stuffer may find these fluorescence marks provide a low hurdle to overcome. It has been discovered that the use of phosphoresce inks can provide advantages in preventing counterfeiting.

In one embodiment, the roll comprises an overt indication that is visible to the human eye that can act as a decoy to potential counterfeiters and a covert indication that is not visible by the human eye. A supplier of the product may vary the overt indication for different production runs to keep the potential counterfeiter guessing as to the purpose of the indication, while the covert indication is the indication actually used to determine whether or not a product is authorized or unauthorized.

Figure 4:
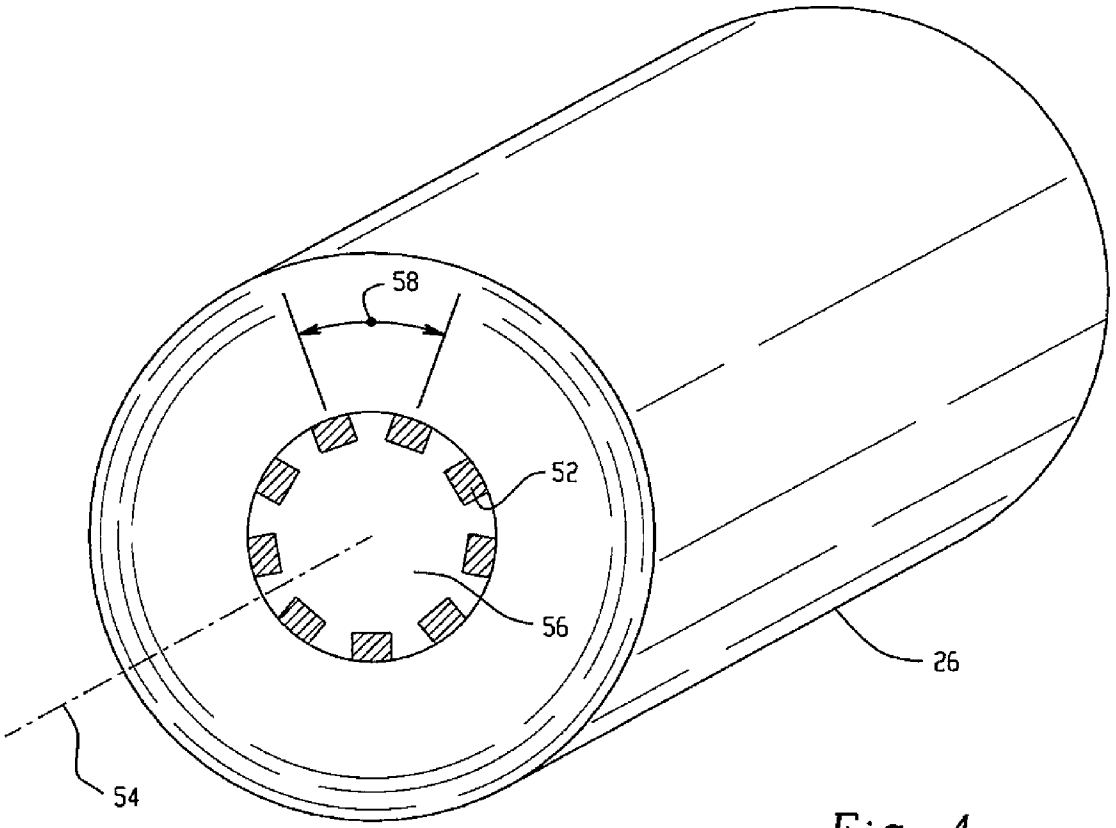
FIG. 4 is a perspective view of a roll of sheet product in accordance with an embodiment of the invention.
Figure 5:
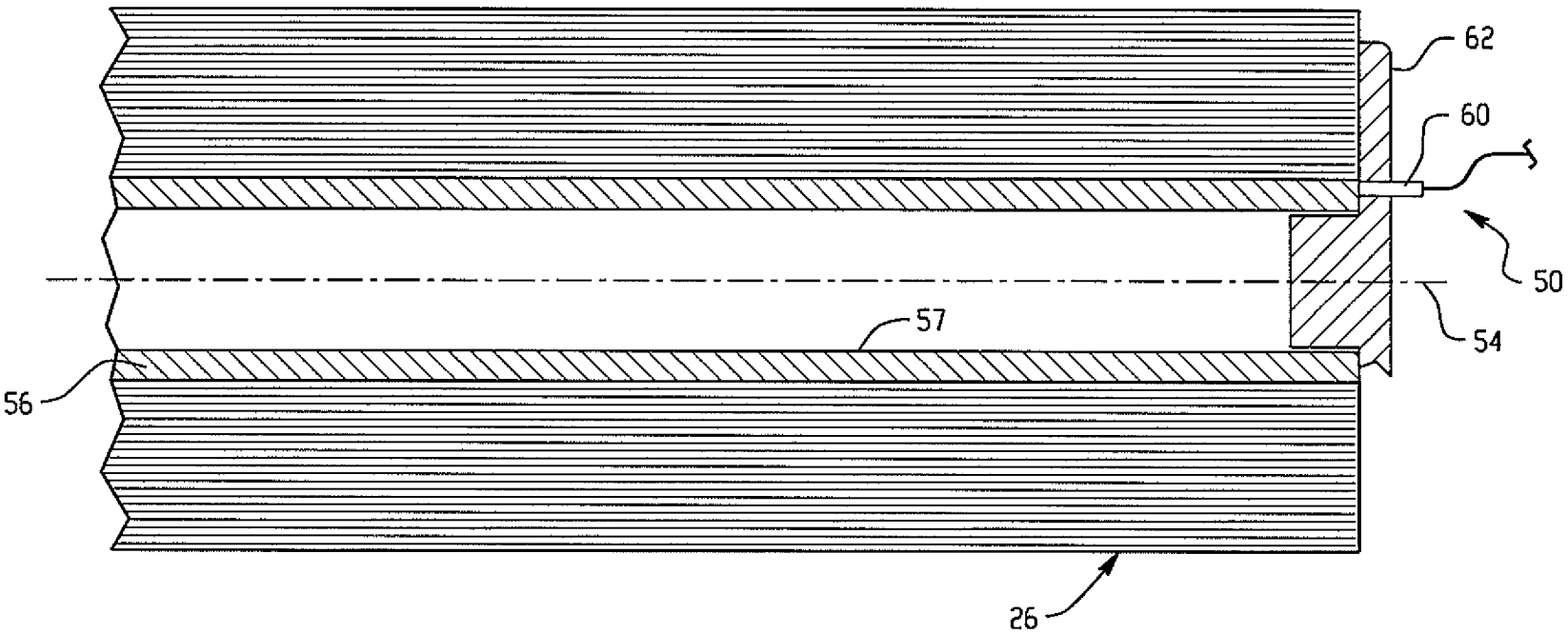
FIG. 5 is a cross section view of a detector in conjunction with the roll of sheet product of FIG. 4 in accordance with an embodiment of the invention.

FIGS. 4 and 5 depict an embodiment in which the detector 50 may include use of a plurality of reference indications 52 disposed upon the roll 26 of sheet product proximate a center axis 54 of the roll 26 printed upon a core 56 of the roll 26, for example. In one embodiment, the reference indications 52 are spaced at a regular interval 58, such as from center to center, or leading edge to leading edge, for example. However, other embodiments are envisioned where the reference indications 52 are spaced at irregular intervals (e.g., bar codes). The detector 50 includes a sensor 60. The type of sensor employed as sensor 60 varies depending on the reference indication 52 employed. Suitable sensors include, but are not limited to, an optical reflectivity sensor (e.g., a linear optical array) adapted to detect the presence of a reflective object or code associated with the roll 26, a magnetic sensor adapted to detect the presence of magnetic ink or other magnetic object associated with the roll 26, a RFID tag sensor adapted to detect and RFID tag associated with the roll 26, a capacitive field disturbance/proximity detector, and an electrical contact sensor to detect the present of a conductive element associated with the roll 26. The sensor 60 is in signal communication with the processor 46 via the detector 50 and is disposed upon a structure 62 proximate the core 56, such as roll supports defined in conjunction with hubs 32, 34 as described above and shown in reference to FIGS. 1 and 2.

FIG. 5 depicts one embodiment of a mounting arrangement of the sensor 60. The sensor 60 can be utilized in conjunction with the reference indications 52 (best seen with reference to FIG. 4) to sense the presence or absence of the reference indications 52. The sensor 60 is mounted to the structure 62, which remains stationary relative to the roll 26 as it rotates about the center axis 54. As the roll 26 rotates about its center axis 54, the reference indications 52 are alternatively disposed in front of the sensor 60. Therefore, rotation of the roll 26 results in a pulse train that can be detected by the detector 50 and corresponds to rotation of the reference indications 52 past the sensor 60. Further, in one embodiment, the sensor 60 is responsive to removal of the roll 26 to sense an increase in ambient light and recognize the removal of the roll 26.

Figure 6:
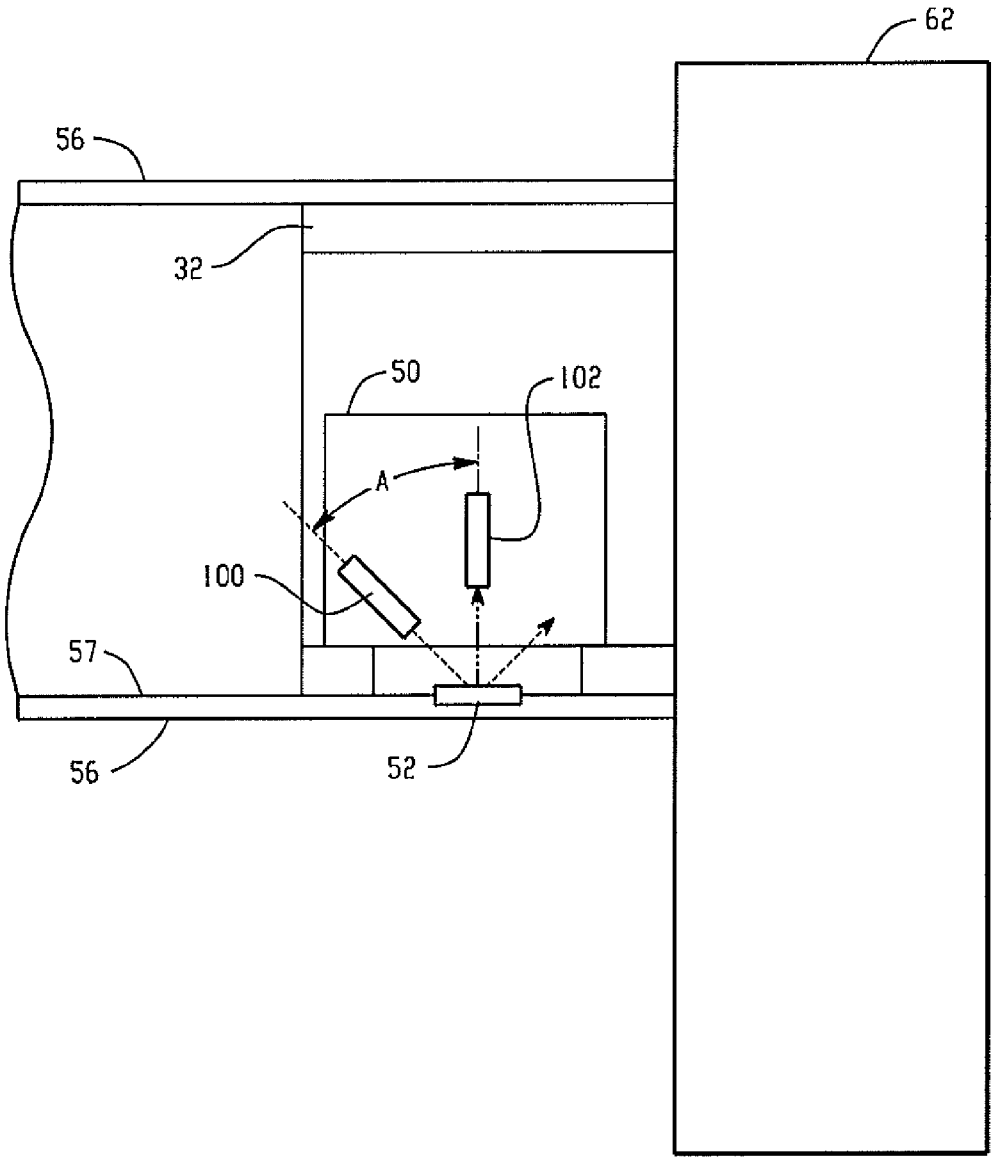
FIG. 6 is partial side sectional view of a roll holder with an authentication sensor in accordance with an embodiment of the invention.

Another embodiment of the detector 50 is shown in FIG. 6. In this embodiment, the detector 50 includes an optical emitter 100 and an optical receiver 102 positioned within the hub 32. In this embodiment, the reference indication 52 is arranged on the inside diameter 57 or the core 56. The optical emitter 100 and the optical receiver 102 may be discrete components as shown, or integrated into a single device. The optical emitter 100 and the optical receiver 102 are arranged such that the light emitted from the optical emitter 100 is directed at the reference indication 52 to excite pigments in the reference indication 52 when the roll 26 is positioned within the sheet dispenser 10. In one embodiment, the optical emitter 100 is positioned to direct the light on an angle "A", such as 45 degrees for example, relative to the reference indication 52. The angle "A" provides advantages in reflecting a substantial portion of the light from optical emitter 100 away from the receiver after striking the reference indication 52. This allows a substantial portion of the light directed toward the optical receiver 102 to be from the phosphorescence of reference indication 52, rather than the optical emitter 100. The optical receiver 102 is positioned substantially perpendicular to the reference indication 52 in a position to receive photons of light emitted by the phosphoresce of the pigments in the ink of reference indication 52. In the exemplary embodiment, the detector 50 is positioned 0.5 inches (0.0127 meters) within the core of roll 26. The hub 32 may define the depth of the detector 50 into the core 56. It should be appreciated that positioning the detector 50 within the core of roll 26 provides advantages in reliability by preventing or limiting ambient light from interfering with the operation of optical receiver 102.

Once the pigment in reference indications 52 have been excited by the ultraviolet light from the optical emitter 100, the reference indication 52 emits a light with a known intensity signature 104 at a know frequency range as illustrated in FIG. 7. In the exemplary embodiment, reference indications 52 phosphoresce in the red spectrum (620 nanometers to 750 nanometers). In other embodiments, the reference indications 52 phosphoresces in the green spectrum (495 nanometers to 570 nanometers). The optical receiver 102 is positioned to receive the light emitted by the reference indications 52. The optical receiver 102 generates a voltage that is proportional to the intensity of the light being emitted. In some embodiments, there is a delay or reaction time between when the light is emitted from the optical emitter 100 and the pigment phosphoresces. In the exemplary embodiment, the reaction time is less than 15 milliseconds and the optical receiver 102 generates a voltage of at least 10 millivolts in response to receiving light from the reference indications 52.

For a particular pigment, the intensity signature 104 generated by the optical receiver 102 will be remain substantially consistent, both over time for a particular pigment and between manufacturing production lot. As will be discussed in more detail below, in the exemplary embodiment, there is a nonlinear decay portion 106 that may be used to determine whether the sheet product 28 is authorized for use in sheet dispenser 10.

Figure 8:
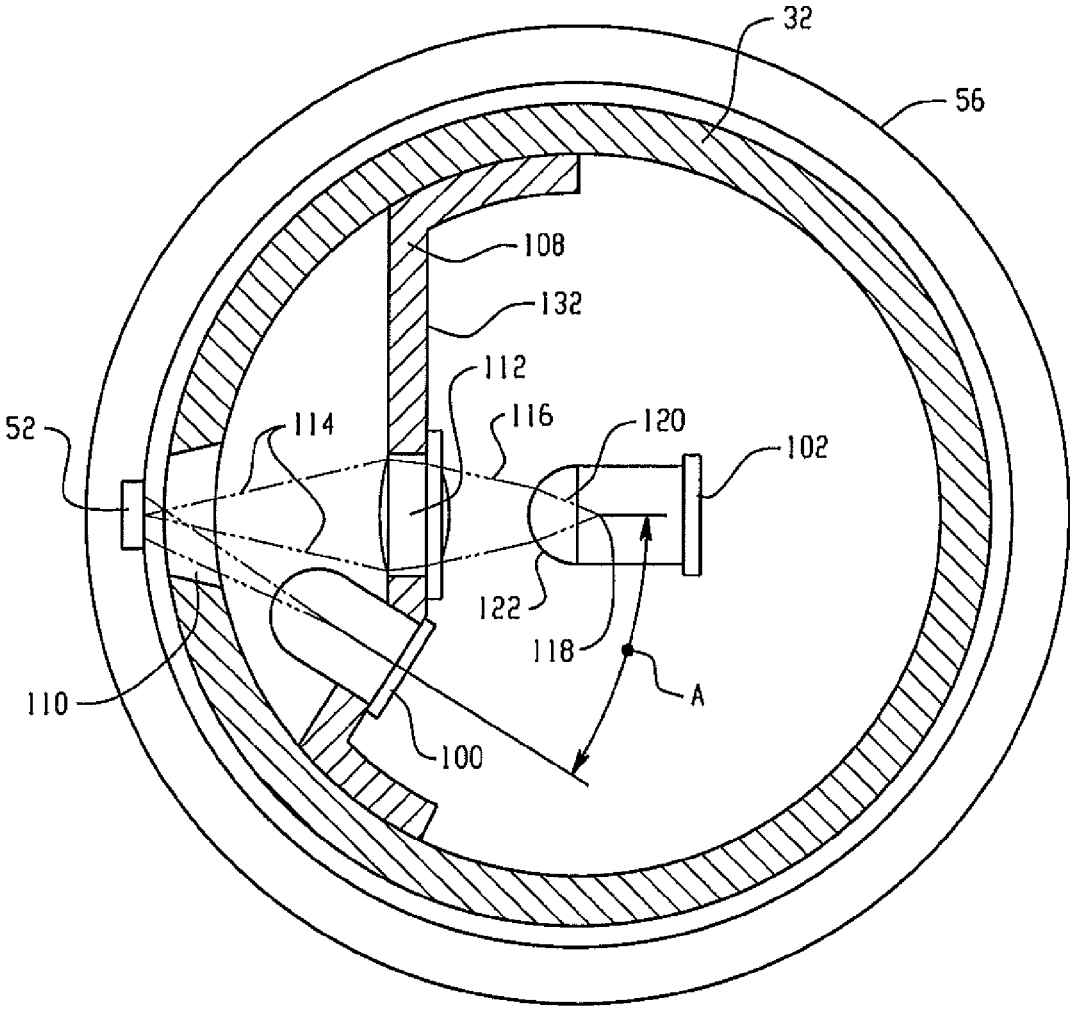
FIG. 8 is a partial side sectional view of a roll holder with an authentication sensor in accordance with another embodiment of the invention.
Figure 10:
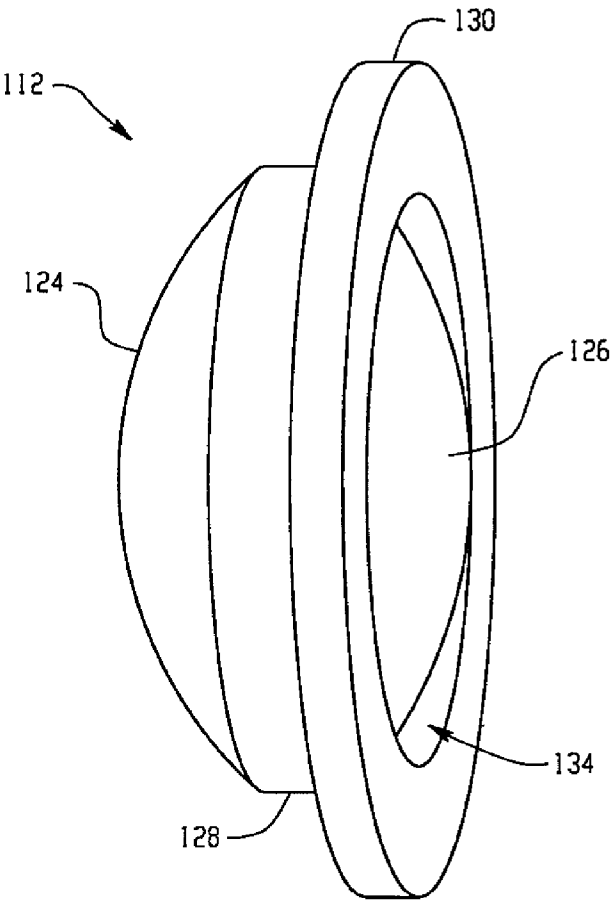
FIG. 10 is a perspective view illustration of the lens of FIG. 9.
Figure 9:
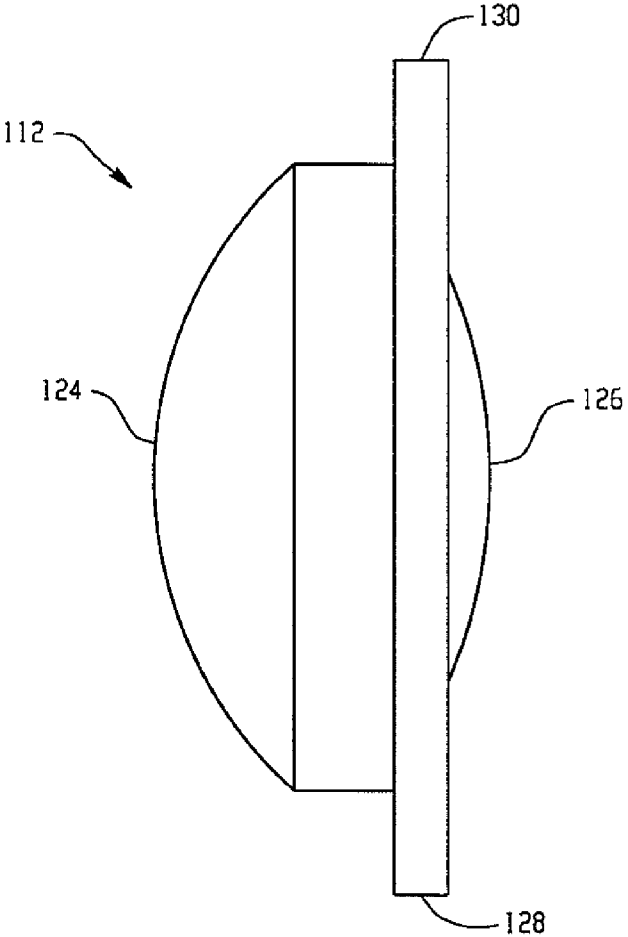
FIG. 9 is a side plan view of a lens used in the authentication sensor of FIG. 8.

Another embodiment of detector 50 is illustrated in FIG. 8-10. This embodiment includes an optical emitter 100 and an optical receiver 102 is mounted within the hub 32. A frame 108 is mounted to the hub 32 and allows the mounting of optical emitter 100 on the desired angle "A" relative to the optical receiver 102. As discussed above, by directing the light from the optical emitter 100 on an angle, the light from the optical emitter 100 will excite the pigments in reference indication 52 while reducing the amount of emitted light being reflected towards the optical receiver 102. The optical emitter 100 is arranged to direct an emitted light through an opening 110 in the hub 32. The opening 110 is positioned to allow the emitted light to strike the reference indication 52 on the core 56.

Positioned between the opening 110 and the optical receiver 102 is a lens 112. The lens 112 is arranged to receive the phosphoresce UV light 114 from the reference indications 52 and focus the output UV light 116 to a reception location 118 on the optical receiver 102. In the exemplary embodiment, the optical receiver 102 is positioned an offset distance from the lens 112 to compensate for the refraction of light 120 by the lens 122 of the optical receiver 102. It should be appreciated that in embodiments where the optical receiver 102 does not have a lens 122, the distance between the lens 112 and the optical receiver 102 may be adjusted, or the shape of the lens 112 may be changed.

An exemplary embodiment lens 112 is illustrated in FIG. 9 and FIG. 10. In the exemplary embodiment, the lens 112 is made from a material having a high UV transmission performance such as G UVT grade acrylic for example. The lens 112 includes an input surface 124 and an output surface 126. As discussed above, the surfaces 124, 126 refract the UV light allowing the light to be focused on reception location 118. In the exemplary embodiment, the surfaces 124, 126 are aspheric in shape. In some embodiments, the surfaces 124, 126 are configured with different aspheric shapes. In further embodiments, one of the surfaces 124, 126 may be substantially flat. Disposed adjacent the input surface 124 is a cylindrical body portion 128. The body portion 128 is sized to fit in an opening in the frame 108. A shoulder 130 extends from the body portion 128. The shoulder 130 contacts a surface 132 (shown in FIG. 8) on the frame 108 when the frame 108 and lens 112 are assembled to allow the lens 112 to be reliably located in the desired position. In the exemplary embodiment, the output surface 126 is arranged in a recess 134.

It should be appreciated that the focusing of the phosphoresce UV light 114 provides advantages in increasing the amount of emitted light from the reference indication 52 that reaches the reception location 118 on the optical receiver 102.

By increasing the amount of the emitted light, further advantages may be gained by reducing the concentration, the density or the amount of pigment in the reference indications 52. In addition, it has been found that less costly, lower grade components, sometimes referred to as "production grade" components may be used instead of "laboratory grade" components.

Referring now to FIGS. 11-12 a method of dispensing products from a sheet dispenser 10 will now be described. The method may be followed out employing the electrical control system as shown in FIG. 3, and the method may include additional or fewer actions as shown in FIGS. 11-12. Thus, it should be apparent to those ordinarily skilled in the art that the method can be modified depending on a desired application to yield additional methods within the scope of the present invention.

A method 200 comprises a sheet product authentication check as shown in FIG. 11. The method 200 starts in block 202 and proceeds to block 204 where a signal to dispense product is received, such as from sensor 48 for example. The method 200 then proceeds to block 206 where light is emitted from a UV light emitting diode, such as optical emitter 100 for example. In one embodiment, the UV light is emitted before the feed mechanism 36 is activated. In other embodiments, the feed mechanism 36 is activated and sheet product 28 starts to be dispensed and the method 200 operates in parallel.

After emitting the UV light, method 200 proceeds to query block 208 where it is determined if a phosphoresce has been detected, such as with optical receiver 102 for example. In one embodiment, the excitation light from the optical emitter 100 is extinguished prior to the step of detecting for phosphoresce. If query block 208 returns a negative, the method 200 proceeds to block 210 where an unauthorized sheet product procedure is executed. The actions (or lack thereof) taken by the method 200 in the event unauthorized sheet product 28 is detected may include, but is not limited to: stop dispensing; dispensing an excess amount of sheet product 28; dispensing short sheet product; emitting an alarm; or using a communications device (not shown) to transmit a signal to a central location for example.

If the query block 208 returns a positive, the method 200 proceeds to optional query block 211 where the method 200 determines if the wavelength received is in the proper portion of the light spectrum, such as the red spectrum for example. If the query block 211 returns a negative, negative, indicating that the spectrum is not the desired spectrum, the method 200 proceeds to block 210 where an unauthorized sheet product procedure is executed. If the light spectrum is the desired spectrum, then method 200 proceeds to block 212 where the intensity of the phosphoresce is measured. In the exemplary embodiment, the measurements ($I_1$, $I_2$) are taken at defined points of time after the UV light is emitted, such as $t_3$ and $t_4$ in the nonlinear decay portion 106 of the intensity signature 104 for example. In the exemplary embodiment, the measurement points are 10 milliseconds apart. In another embodiment, a plurality of measurements are made, such as at $t_1$, $t_2$, $t_3$ and $t_4$ for example. This plurality of measurements is then used in an optional query block 214 to determine if the measurements match the expected profile for the pigment in the reference indications 52. If query block 214 returns a negative, indicating that the intensity signature 104 does not match, the method 200 proceeds to block 210 where an unauthorized sheet product procedure is executed. As discussed above, in some embodiments, the emitted UV light is extinguished prior to $t_0$.

After measuring the intensity of the phosphorescence, the method 200 proceeds to block 216 where the change in intensity ($\Delta I = I_1 - I_2$) from time $t_3$ to time $t_4$ is calculated. As discussed above, the pigments used in the reference indications 52 demonstrate a consistent and reliable rate of decay in intensity. This nonlinear decay portion 106 acts as a signature that may be used to determine if the sheet product 28 is authorized product. Since the nonlinear decay portion 106 is nonlinear, a potential counterfeiter would need to replicate a nonlinear rate of decay and know what time periods the method 200 is measuring. Thus the use of the nonlinear decay portion 106 as a signature for detecting unauthorized product provides advantages in consistency and reliability and inhibiting attempts to replicate or defeat the authentication method. It should be appreciated that the use of a nonlinear portion of the intensity signature 104 provides advantages in making is more difficult for a potential counterfeiter to replicate the reference indication 52.

In one embodiment, the method 200 changes the time periods for calculating the change in intensity $\Delta I$ to further inhibit attempts to replicate or defeat the authentication method.

After calculating the change in intensity $\Delta I$, the method 200 proceeds to block 218 where the change in intensity $\Delta I$ is compared to an expected value. If the value does not match the change in intensity $\Delta I$, the query block 218 returns a negative and the method 200 proceeds to block 210 where an unauthorized sheet product procedure is executed. If the change in intensity $\Delta I$ does equal the value, the method 200 proceeds to block 220 where sheet product 28 is properly dispensed. The method 200 then loops back to start block 202. In some embodiments, the change in intensity $\Delta I$ may be compared against a range of values rather than an absolute value. It should be appreciated that the method 200 provides advantages in the reliable and seamless authentication of sheet product 28 with little or no impact on the operation or user experience.

Another method 300 comprising a sheet product authentication check is shown in FIG. 12. In some applications, counterfeiters attempt to thwart prior art authentication systems by inserting the core 56 into a core of an inauthentic product. The method 300 provides a system for checking to ensure that an old core 56 is not being used.

The method 300 starts in block 302 and proceeds to block 304 where the radius of the roll is estimated. It should be appreciated that the sheet dispenser 10 dispenses a substantially consistent amount of sheet product 28 to the end user each time the sheet dispenser 10 is activated. However, the number of rotations, or the amount of time, the sheet dispenser 10 needs to operate will change depending on the amount of sheet product 28 on the roll 26. When the roll 26 is new, and the roll radius is large, the sheet dispenser 10 will rotate the roll 26 less times than when roll radius is smaller to achieve the same amount of dispensed sheet product 28. The roll radius may be estimated in a number of ways, for example by accumulating the amount of sheet product 28 dispensed since the roll 26 was installed.

After the roll radius has been estimated, the method 300 proceeds to block 306 where the method 300 calculates the number of reference indications 52 that should be detected when the sheet product 28 is dispensed. As discussed above, to dispense a consistent amount of sheet product 28, the roll 26 will rotate less when the roll radius is large, than when the roll radius is small. The method 300 then proceeds to block 308 where a dispense signal is received, such as from sensor 48 for example. It should be appreciated that in some embodiments, the block 308 may occur before blocks 304, 306 or in parallel with these steps.

The method 300 then proceeds to block 310 where the number of reference indications 52 is counted ($C_{ref}$) as the sheet product 28 is dispensed. The method 300 also measures the operation of the feed mechanism 36 ($C_{feed}$) in block 312, such as by counting the number of rotations of the pressure roller 42 or feed roller 40 for example. The measurement of the feed mechanism 36 provides an indication to the method 300 of the amount of sheet product 28 actually dispensed. It should appreciated that while block 310 and block 312 are illustrated as occurring in series, these steps may also be performed simultaneously.

The method 300 then proceeds to block 314 where the number of counted reference indications 52 ($C_{ref}$) is compared to the measurement of the feed mechanism 36 ($C_{feed}$). When an authorized product has been installed, the number of reference indications 52 counted ($C_{ref}$) should be substantially consistent with the operation of the feed mechanism 36 ($C_{feed}$). If this is true, then the query block 314 returns a positive and the method 300 loops back to start block 302.

If the query block 314 returns a negative, this is an indication that an old core 56 has been inserted into unauthorized product. It should be appreciated that when an old core 56 is inserted into an unauthorized product, there will be slippage between the old core 56 and the core 56 of the unauthorized product. Since this is not the intended operation of the sheet dispenser 10 and sheet product rolls 26, the slippage will typically be inconsistent between different dispensing operations. Further, the amount of slippage within a given dispensing operation may be inconsistent. Thus, a comparison of the measurements of reference indications 52 ($C_{ref}$) to the feed mechanism 36 operation ($C_{feed}$), may provide an indication of the amount of slippage. In some embodiments, the query block 314 compares the number of reference indications 52 measured ($C_{ref}$) to previous dispensing operation measurements. It has been found that when old cores 56 are inserted into unauthorized product, the number of reference indications 52 measured ($C_{ref}$) there may be large variations in the number of reference indications 52 measured ($C_{ref}$) measured, while the feed mechanism 36 operation ($C_{feed}$) remains consistent.

If the query block 314 returns a negative, the method 300 proceeds to block 316 where an unauthorized roll procedure (URP) is executed. As discussed above in reference to method 200, the unauthorized roll procedure may include, but is not limited to: stop dispensing; dispensing a long sheet product 28; dispensing short sheet product 28; emitting an alarm; or using a communications device (not shown) to transmit a signal to a central location for example.

In some embodiments, the method 200 shown in FIG. 11 and the method 300 shown in FIG. 12 are performed together to check sheet product 28 authentication in a sheet dispenser 10.

In one embodiment, the sheet product 28 has been encoded with certain product identification information. The sheet dispenser 10 is configured to obtain product identification information by one or more sensing/detection methods. For example, in some embodiments a light source and a photo detector may be used to obtain product identification information. The light source and the photo detector can be placed within the sheet dispenser 10 in such a location as to obtain product identification information placed at one or more predetermined locations on the product. In such a configuration, the light source can direct light at a predetermined wavelength toward the product. The sheet product 28 can be configured to include a dye mark that will reflect back light provided by the light source. The photo detector can be configured to receive light reflected back by the dye mark.

The method can also include continuous checking of sheet product 28 during dispensing operations. Such testing can be performed at predetermined intervals by microprocessor 46. In addition, such testing may be performed in response to end user activity receiving sheet product 28 from the sheet dispenser 10. This enables a process to continuously monitor sheet product 28 for dispensing and end user interaction with a sheet dispenser 10.

If it is determined at product check that authorized product is being employed in the sheet dispenser 10, the sheet dispenser 10 will dispense sheet product 28 per an authorized product schedule. For example, the authorized product schedule can be the amount of sheet product 28 the sheet dispenser 10 is normally set to dispense. If, however, it is determined that unauthorized sheet product 28 is being employed in the sheet dispenser 10, the sheet dispenser 10 will dispense product per an un-authorized product schedule. For example, the un-authorized product schedule can dispense sheet product 28 in a manner to discourage stuffing the sheet dispenser 10 with counterfeit sheet product 28.

One driver for a customer to purchase counterfeit product is price, i.e., a counterfeit product (unauthorized product) is likely to cost less money than an original product (authorized product). In one embodiment, the sheet dispenser 10 discourages stuffing by destroying the cost-in-use proposition for a competitor attempting to "stuff" a propriety sheet dispenser 10 with unauthorized sheet products 28. In other words, a facility operator employing unauthorized sheet product 28 actually ends up spending more money than he would have spent using the authorized sheet product 28, because an excessive amount of sheet product 28 is dispensed when an unauthorized sheet product 28 is employed.

In one embodiment, the sheet dispenser 10 "over delivers" sheet product 28, if an un-authorized sheet product 28 is employed in the sheet dispenser 10. As used herein, the term "over delivery" refers to a pre-determined amount of extra sheet product 28 dispensed compared to a normal dispense cycle if authorized product had been employed. For example, if the sheet dispenser 10 where programmed to dispense "X" amount of authorized sheet product 28, the sheet dispenser 10 can dispense X plus a set amount extra, two times X, three times X, or a greater amount, if un-authorized sheet product 28 is employed. The amount can be selected such that the un-authorized sheet product 28 will cost the facility operator more money to dispense un-authorized sheet product 28 than authorized product. The over delivery amount may or may not be noticeable to the end user. However, it may be advantageous to dispense an amount of sheet product 28 that is noticeable to the end user to facilitate communication to the establishment that the sheet dispenser 10 is operating in an unusual manner to aid in detecting that un-authorized sheet product 28 is being employed. For example, in a sheet dispenser 10 it is common to dispense sheet product 28 in amounts less than or equal to about 12 to 14 inches. The sheet length for "over delivery" can be 2 feet to 25 feet in length, specifically a length of 3 feet to 6 feet. In other embodiments, the sheet dispenser 10 can continue dispensing until an entire sheet product roll 26 is depleted. The pile of sheet product 28 on the floor can trigger a complaint to the facility operator. The facility operator can self diagnosis the problem by a warning label disposed on the sheet dispenser 10 indicating that the sheet dispenser 10 may dispense more sheet product 28 if unauthorized sheet product 28 is employed. If the facility operator is unable to diagnosis the problem, the supplier may contact the owner or manufacturer of the sheet dispenser 10, wherein the owner or manufacturer of the sheet dispenser 10 will immediately understand the problem to be un-authorized use of sheet product 28. In other words, inquiries about over delivery of sheet product 28 can be used as a tool for policing and enforcing leases of proprietary systems.

In other embodiments, the sheet dispenser 10 can "under deliver" product to discourage dispensing of unauthorized sheet product 28. The term "under delivery" refers to a predetermined lesser amount of sheet product 28 to dispense compared to a normal dispense cycle if authorized sheet product 28 had been employed. For example, if the sheet dispenser 10 where programmed to dispense "X" amount of authorized product, the sheet dispenser 10 can dispense half of X, a quarter of X, or a lesser amount if un-authorized sheet product 28 is employed. While under deliver may not destroy the cost-in-use proposition compared to over delivery, it does provide another means of detecting whether or not un-authorized product is being employed.

In other embodiments, the sheet dispenser 10 can dispense product a "slower" speed compared to the speed at which sheet product 28 is dispensed during normal operation. For example, if the sheet dispenser 10 where programmed to dispense "X" amount of authorized sheet product 28 per second, the sheet dispenser 10 can dispense half of X per second, a quarter of X per second, or a lesser amount per second, if un-authorized sheet product 28 is employed. Again, while a slower deliver speed may not destroy the cost-in-use proposition compared to over delivery, it does provide another means of detecting whether or not authorized sheet product 28 is being employed.

Without wanting to be bound by theory, it is believed that by not employing a lock-out scheme; goodwill with the end-user associated with the branded sheet dispenser 10 is maintained. In other words, in schemes where a sheet dispenser 10 is locked-out or disabled when an unauthorized sheet product 28 is loaded into the sheet dispenser 10, the end-user (i.e., the person using the sheet dispenser 10) may form a negative impression of the branded sheet dispenser 10. Whereas, by employing a design where the sheet dispenser 10 still dispenses sheet product 28 even when un-authorized product is employed, the goodwill associated with the brand is maintained, since the sheet dispenser 10 reliably dispensed paper. The un-authorized dispensing schedules discussed above discourage stuffing of the sheet dispenser 10 with unauthorized sheet products 28, while trying to minimize any negative impressions that can tarnish the goodwill associated with a sheet dispenser 10.

In other embodiments, to further limit negative impressions, the sheet dispenser 10 may provide feedback to the end user, the facility operator, the owner of the sheet dispenser 10, and the like that unauthorized sheet product 28 has been employed. For example, in response to the loading of sheet product 28 absent the reference indications 52, the sheet dispenser 10 provides feedback to an external party, such as to a servicing attendant or sheet product 28 user for example, that such unauthorized sheet product 28 has been loaded. As used herein, the term "feedback" shall be defined as an action taken by the sheet dispenser 10 to indicate to the external party that such unauthorized sheet product 28 has been loaded into the sheet dispenser 10. It will be appreciated that "feedback" is distinguished from inactivity (e.g., "locking out" or deactivation) of the sheet dispenser 10. Indeed, the sheet dispenser 10 is programmed to dispense sheet product 28, even if an unauthorized sheet product 28 is loaded into the sheet dispenser 10; the sheet dispenser 10 does not employ a "lock-out" scheme, if unidentified sheet products 28 are employed in the sheet dispenser 10.

In one embodiment, the microprocessor 46 may be responsive to loading of such material absent the reference indications 52 to indicate use of unauthorized sheet product 28 by flashing a light-emitting-diode (LED) 154 (FIG. 3) and/or set of an alarm. In other embodiments, the sheet dispenser 10 may also communicate that unauthorized sheet product 28 has been employed by communication to a cellphone, personal data assistant (PDA), a pager, telephone, email, and the like. For example, the sheet dispenser 10 may optionally comprise a wireless modem or other wireless networking components disposed within the housing such that those providing the sheet dispenser 10 to end users can wirelessly monitor status information about the sheet dispenser 10.

Referring back to FIG. 3, an embodiment of sheet dispenser 10 (alternatively herein referred to as an electronic product dispenser) includes a control panel 400 that provides an HMI (human machine interface) between a user and the microprocessor 46 (alternatively herein referred to as a processor). In an embodiment, control panel 400 includes a plurality of LEDs (light emitting diodes) 410, a plurality of control switches 420, and a control button 430, all of which are disposed in signal communication with the processor 46.

In an embodiment, the plurality of LEDs 410 includes a first LED 412, a second LED 414, and a third LED 416. The first LED 412 is used to indicate the presence of an unauthorized roll in dispenser 10 by signaling activation of an unauthorized roll procedure, and is also used to indicate proper operation of an authorized roll procedure, which will be discussed further below. As used herein, the term "authorized roll procedure" means normal (without purposeful alteration of dispensing action, as discussed above) sheet product dispensing when an authorized roll is placed in the dispenser 10. The second LED 414 is used to indicate the presence of an operational error, such as a jammed feed mechanism 36, for example. The third LED 416 is used to indicate a low voltage condition of battery 370. While three LEDs 410 are depicted, it will be appreciated that fewer or more LEDs may be employed without detracting from the scope of the invention disclosed herein.

In an embodiment, the plurality of control switches 420 includes a first switch 422, a second switch 424, and a third switch 426. In an embodiment, the first switch 422 has three settable positions, the second switch 424 has three settable positions, and the fourth switch 426 has two settable positions. In an embodiment, the first switch 422 is used to adjust the sensitivity of the sensor 48 for dispensing sheet product, with the three sensitivity settings providing adjustment for a user's hand being "close", "near" and "far" from the sensor 48, for example. In an embodiment, the second switch 424 is used to adjust the length of sheet product 28 dispensed, with the three length settings providing relative sheet lengths such as "short", "medium" and "long", for example. In an embodiment, the third switch 426 is used to change modes of operation, such as from "hang" mode to "demand" mode, for example. In an embodiment, the sensitivity settings of the first switch 422 only apply to "demand" mode, while the sheet length settings of the second switch 424 apply to both "hang" mode and "demand" mode.

When in "hang" mode, processor 46 operates to facilitate dispensing of sheet product 28 following the removal of a previously dispensed sheet product 28 by a user, thereby resulting in a next-in-line sheet product "hanging" from the dispenser ready for removal by a next user. When in "demand" mode, processor 46 operates to facilitate dispensing of sheet product 28 on receipt of a sheet request signal (product dispense request) from sensor 48, thereby substantially concealing the next-in-line sheet product from view until a dispense command is received.

While three switches 420 are depicted, having two or three settable positions, it will be appreciated that fewer or more switches, with fewer or more settable positions, may be employed without detracting from the scope of the invention disclosed herein. For example, a fourth switch (not shown) may be used with three settable positions to adjust a time delay between sheet product dispense cycles, with the three settings providing a long (three seconds for example), a medium (two seconds for example), and a short (one second for example) time delay. Alternatively, the three switches 422, 424, 426 may be selected from any combination of the foregoing four switches. Other switch functions are contemplated and considered within the scope of the invention.

In an embodiment, the control button 430 is a push-and-release-type button having a two-state action; a first active state when depressed, and second inactive when released. In an embodiment, the control button 430 functions in cooperation with the cover switch 136, with the processor 46 controlling the function of the control button 430 depending on whether the cover switch 136 indicates that the dispenser cover 22 is open or closed. Other types of control devices may be used in place of control button 430, such as a toggle-type switch for example, which are considered within the scope of the invention.

When the cover 22 is closed, the control button 430, which is accessible to a user via an aperture in the cover 22 (hidden from view in FIG. 1), functions as a manual feed button, and in an embodiment has two operational characteristics. First, when the control button 430 is momentarily depressed (activated-then-released) and the cover 22 is closed, the control button 430 facilitates dispensing via the feed mechanism 36 of only a single-dispense-portion of sheet product 28 from the dispenser 10. And second, when the control button 430 is held depressed (held activated) and the cover 22 is closed, the control button 430 facilitates dispensing via the feed mechanism 36 of more than a single-dispense-portion of the sheet product 28 from the dispenser 10. In an embodiment, the "more than a single-dispense-portion" means that the sheet product 28 is dispensed until a user releases the control button 430 to its inactive state.

When the cover 22 is open, the control button 430 functions as a test button to provide indication that the program coding executable by processor 46 is functioning properly in the presence of an authorized roll 26 being placed in the dispenser 10. When an authorized roll 26 is placed in the dispenser 10, detector 50 adjacent to the roll 26 determines the presence of reference indication 52 as discussed above. In response to control button 430 being depressed, and conditional on the cover 22 being open, and conditional on an authorized roll procedure (discussed above) being enabled, the first LED 412 flashes to provide indication that an authorized roll 26 of sheet product 28 is disposed in the dispenser 10. While embodiments disclosed herein make reference to the first LED 412 being an indicator (means of indicating) that indicates the presence of an authorized roll 26, it will be appreciated that other means of indicating, such as by a buzzer, a beep, or any other sound for example, may be employed without detracting from the scope of the invention. Such other indicators are considered within the scope of the invention.

Additional functionality may be given to the control button 430 when the cover 22 is open. A first functionality may be provided as discussed above when the control button 430 is momentarily depressed (activated-then-released within two seconds for example). Here, and as discussed above, the control button 430 is used to test the proper operation of the authorized roll procedure coding. A second functionality may be provided by holding the control button 430 in an active state for an extended period of time, such as for five seconds for example. Here, the program coding executable by processor 46 interprets the extended depression of control button 430 to be a request to run one of a plurality of diagnostic tests, which may be used to test the operational health of the dispenser 10. Such diagnostic tests may include but are not limited to: testing for the amount of energy/life remaining in the batteries 370; testing for operational signals being properly sent and received from the various sensors/detectors/switches/indicators 48, 50, 53, 136, 154; testing for error detection in memory 154; and, testing for proper functioning of feed mechanism 36 and feed motor 38, to name a few. Here, the settings of control switches 420 take on a dual function. The first function being that discussed above, sensitivity adjustment, length adjustment, and mode setting, for example, when control button 430 is momentarily depressed. The second function of control switches 420 when the control button 430 is held depressed/active for an extended period of time is to provide a test identification number that is dependent on and is in a one-to-one relationship with the settable positions of the plurality of switches 420. For example, with the first switch 412 having three settable positions, the second switch 414 having three settable positions, and the third switch 416 having two settable positions, the resulting number of combinations of settable positions is eighteen (three times three times two). By using time-of-activation (two seconds or five seconds for example) of control button 430 as a logic-control parameter, a high degree of utility can be implemented into the control panel 400 of dispenser 10 without the need for extraneous hardware and real estate on control system circuit boards.

Notwithstanding the foregoing, embodiments of the invention also contemplate lesser intelligent systems. For example, the control button 430 could be disposed in such a manner as to be used independent of the state of the cover switch 136 (no intelligence programmed into the processor 46 for comparing the state of the control button 430 with that of the cover switch 136). Here, the control button 430 may be concealed from a user while being accessible to maintenance personnel, thereby providing manual feed dispensing, for example, of sheet product 28 only by maintenance personnel.

In another example of a lesser intelligent system, a second control button (not shown) could be employed to provide the logic intelligence provided by the "time-of activation" of control button 430 discussed above. That is, instead of the processor 46 interpreting an extended depression of control button 430 to be a request to run one of a plurality of diagnostic tests, as discussed above, the second control button (not shown) is used to convey this same request.

Such lesser intelligent embodiments are contemplated and considered within the scope of the invention.

Referring now to FIG. 13, which depicts in flow diagram form a portion of a method 500 of controlling product dispensing from the sheet dispenser 10, which is operative under battery power, via batteries 370, and includes processor 46 that is responsive to a product dispense request, via sensor 48, to facilitate dispensing of sheet product 28 from the sheet dispenser 10 on command. Here, method 500 is depicted having two program logic entry points. A first entry point 505 is when batteries are installed, and a second entry point 525 is when program logic transfers to the method 500 from another segment of the executable code. Such other segments resulting in logic transfer may include but are not limited to: a portion of the executable code that monitors the activity and/ or state of a tear bar (not specifically shown but known generally in the art), and defines executable instruction dependent on the state thereof, a portion of the executable code that monitors the open or closed state of the cover 22, and defines executable instruction dependent on the state thereof; and, a portion of the executable code that monitors the state and/or activity of a service manual feed operation, and defines executable instruction dependent on the state thereof, for example.

When batteries are installed, referring now back to logic block 505, control logic passes through two initialization stages 510 and 515 where a power up sequence is processed, and a stub roll transfer reset sequence is processed, and then passes to logic block 520, which is a point of convergence for control logic entering at first entry point 505 or second entry point 525. At block 520, it is determined if there exists a low voltage condition at batteries 370. If not, then logic passes to block 540 where sheet product 28 is automatically fed as requested. If a low voltage condition does exist at batteries 370, then logic passes to block 530 where it is determined if an unauthorized roll procedure has been enabled (the unauthorized roll procedure being discussed above). If the unauthorized roll procedure has not been enabled, first LED 412 will be OFF and the logic passes to block 540. However, in the event that the unauthorized roll procedure has been enabled, then first LED 412 will be ON (constant ON, not flashing as discussed above in relation to an authorized roll), and the logic passes to block 535, where the unauthorized roll procedure (URP) is disabled. As such, in response to a low voltage condition existing at the batteries 370 that is below a threshold voltage level, the unauthorized roll procedure is disabled if it was previously enabled. By disabling the unauthorized roll procedure under conditions where a low battery voltage condition exists, unintended operation of the dispenser 10 that may result under a low battery voltage condition can be avoided. In an embodiment, the operational voltage of batteries 370 is 5.0 volts, and the threshold voltage condition that triggers disabling of an unauthorized roll procedure is 4.0 volts. However, it is contemplated that other operational and/or threshold voltages may be employed without detracting from the scope of the invention disclosed herein.

After block 540, control logic passes to routine 550, which determines at block 555 whether "hang" mode or "demand" mode is set, and then passes the control logic to either a "hang" mode operation ("yes" path from block 555), or a "demand" mode operation ("no" path from block 555).

Following the "demand" mode operation, control logic passes to block 560 where a power saver routine is activated, which may be interrupted by a user request for sheet product at block 565, sensing of a cover open condition at block 570 (via cover switch 136), or sensing actuation of the manual feed button (control button 430) at block 575. If there is no interrupt, then control logic stays in the power saver mode 560. However, if there is an interrupt, then control logic passes to one of the subroutines at blocks 580 (subroutine to dispense sheet product/paper), 585 (subroutine to service an open cover condition), or 590 (subroutine to service a manual feed request). Control logic exiting to subroutines 580, 585, 590 can pass back into method 500 via entry point 525.

An embodiment of the invention may be embodied in the form of processor-implemented processes and apparatuses for practicing those processes. Embodiments of the present invention may also be embodied in the form of a processor program product having program code containing instructions embodied in tangible media, such as floppy diskettes, CD-ROMs, hard drives, USB (universal serial bus) drives, processor memory, or any other processor readable storage medium, wherein, when the program code is loaded into and executed by a processor, the processor is responsive to the executable instructions and becomes an apparatus for practicing the invention. Embodiments of the invention also may be embodied in the form of instructions, or program code, for example, whether stored in a storage medium, loaded into and/or executed by a processor, or transmitted over some transmission medium, such as over electrical wiring or cabling, through fiber optics, or via electromagnetic radiation, wherein when the instructions or program code are loaded into and executed by a processor, the processor becomes an apparatus for practicing the invention. When implemented on a general-purpose microprocessor, the instructions or program code segments configure the microprocessor 46 to create specific logic circuits. A technical effect of the executable instructions is to dispense and measure a length of sheet product 28 from a sheet dispenser 10 and to determine the presence of unauthorized sheet product 28.

As disclosed, some embodiments of the invention may include some of the following advantages: an ability to identify sheet product 28 loaded within a sheet dispenser 10; an ability to provide feedback to an external party that unidentified sheet product 28 has been loaded within a sheet dispenser 10; and, by disabling the unauthorized roll procedure under conditions where a low battery voltage condition exists, unintended operation of the dispenser 10 that may result under a low battery voltage condition can be avoided. A particularly useful advantage is the ability of the sheet dispenser 10 to dispense product per an unauthorized product schedule, when an unauthorized sheet product is employed in the sheet dispenser 10. Customers are often tempted to use an inferior quality sheet dispenser 10 in a propriety dispensing system to save money. This practice, however, can destroy the reputation of the manufacturer of the proprietary dispensing system, since the product is often of inferior quality to the sheet product 28 used in the proprietary system. Further, attempts to discourage this practice by locking-out (e.g. disabling) the sheet dispenser 10 can also tarnish the reputation and goodwill associated with the brand of the proprietary system. By dispensing sheet product 28 per an unauthorized product schedule, "stuffing" of the sheet dispenser 10 is discouraged.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. An electronic sheet product dispenser for dispensing sheet product, the sheet product dispenser comprising:

a cover openable with respect to a back panel;

a support configured to rotatably support a roll of sheet product;

a sensor configured to detect a reference indication on the roll, wherein the reference indication is associated with authorized use of the sheet product in the dispenser;

an indicator configured to provide indication relating to presence of an authorized sheet product disposed in the dispenser;

a feed mechanism comprising a drive motor and at least one roller configured to cooperate to advance the sheet product out of the dispenser;

a manual feed button in operative communication with the feed mechanism to advance the sheet product out of the dispenser in response to the manual feed button being activated; and a processor in operative communication with the sensor, the indicator, the feed mechanism, and the manual feed button, wherein the processor is responsive to executable instructions stored on a storage medium, the executable instructions when executed on the processor for performing a method comprising:

determining whether an authorized sheet product or an unauthorized sheet product is disposed in the dispenser, enabling an authorized roll procedure in response to presence of an authorized sheet product being detected, and enabling an unauthorized roll procedure in response to presence of an unauthorized sheet product being detected; and in response to the manual feed button being activated, and conditional on the cover being open, and conditional on the authorized roll procedure being enabled, activating the indicator to provide indication that an authorized sheet product is disposed in the dispenser.

2. The dispenser of claim 1, wherein the processor is responsive to executable instructions for performing the method further comprising:

in response to the manual feed button being momentarily activated, and conditional on the cover being closed, activating the feed mechanism to dispense only a single-dispense-portion of sheet product from the dispenser.

3. The dispenser of claim 1, wherein the processor is responsive to executable instructions for performing the method further comprising:

in response to the manual feed button being held activated, and conditional on the cover being closed, activating the feed mechanism to dispense more than a single-dispense-portion of sheet product from the dispenser.

4. The dispenser of claim 3, wherein the processor is responsive to executable instructions for performing the method further comprising:

in response to the manual feed button being held activated, and conditional on the cover being closed, activating the feed mechanism to dispense sheet product from the dispenser until the manual feed button is released.

5. The dispenser of claim 1, further comprising:

a plurality of control switches, each switch having more than one settable position; and wherein the processor is responsive to executable instructions for performing the method further comprising:

in response to the manual feed button being activated for a first time duration, and conditional on the cover being open, and conditional on the authorized roll procedure being enabled, activating the indicator to provide indication that an authorized sheet product is disposed in the dispenser.

6. The dispenser of claim 5, wherein the processor is responsive to executable instructions for performing the method further comprising:

in response to the manual feed button being activated for a second time duration longer than the first time duration, and conditional on the cover being open, performing one of a plurality of diagnostic tests relating to the dispenser, wherein the plurality of diagnostic tests have a one-to-one relationship with the combinations of the settable positions of the plurality of control switches.

7. The dispenser of claim 6, wherein:

the plurality of control switches comprises a first switch having three settable positions, a second switch having three settable positions, and a third switch having two settable positions, thereby providing eighteen combinations of the settable positions; and the plurality of diagnostic tests comprises eighteen tests having a one-to-one relationship with the eighteen combinations of the settable positions.

8. The dispenser of claim 1, wherein the indicator is further configured to provide indication relating to presence of an unauthorized sheet product disposed in the dispenser, and wherein the processor is responsive to executable instructions for performing the method further comprising:

in response to the manual feed button being activated, and conditional on the cover being open, and conditional on the unauthorized roll procedure being enabled, activating the indicator to provide indication that an unauthorized sheet product is disposed in the dispenser.

9. The dispenser of claim 1, wherein the indicator comprises an LED configured to flash to provide indication relating to presence of an authorized sheet product disposed in the dispenser.

10. A method of controlling product dispensing from an electronic product dispense apparatus, the electronic product dispense apparatus comprising a cover openable with respect to a back panel, a manual feed button in operative communication with a feed mechanism to advance sheet product out of the electronic product dispense apparatus in response to the manual feed button being activated, an indicator, and a processor operative to enable an authorized roll procedure and an unauthorized roll procedure, wherein the processor is responsive to activation of the manual feed button, the method comprising:

determining whether the authorized roll procedure or the unauthorized roll procedure is enabled; and in response to the manual feed button being activated, and conditional on the cover being open, and conditional on the authorized roll procedure being enabled, activating the indicator to provide indication that an authorized sheet product is disposed in the dispenser.

11. The method of claim 10, further comprising:

in response to the manual feed button being momentarily activated, and conditional on the cover being closed, activating the feed mechanism to dispense only a single-dispense-portion of sheet product from the dispenser.

12. The method of claim 10, further comprising:

in response to the manual feed button being held activated, and conditional on the cover being closed, activating the feed mechanism to dispense more than a single-dispense-portion of sheet product from the dispenser.

13. The method of claim 12, further comprising:

in response to the manual feed button being held activated, and conditional on the cover being closed, activating the feed mechanism to dispense sheet product from the dispenser until the manual feed button is released.

14. The method of claim 10, wherein the electronic product dispense apparatus further comprises a plurality of control switches, each switch having more than one settable position, the method further comprising:

in response to the manual feed button being activated for a first time duration, and conditional on the cover being open, and conditional on the authorized roll procedure being enabled, activating the indicator to provide indication that an authorized sheet product is disposed in the dispenser.

15. The method of claim 14, further comprising:

in response to the manual feed button being activated for a second time duration longer than the first time duration, and conditional on the cover being open, performing one of a plurality of diagnostic tests relating to the dispenser, wherein the plurality of diagnostic tests have a one-to-one relationship with the combinations of the settable positions of the plurality of control switches.

16. The method of claim 15, wherein:

the plurality of control switches comprises a first switch having three settable positions, a second switch having three settable positions, and a third switch having two settable positions, thereby providing eighteen combinations of the settable positions; and the plurality of diagnostic tests comprises eighteen tests having a one-to-one relationship with the eighteen combinations of the settable positions.

17. The method of claim 10, further comprising:

in response to the manual feed button being activated, and conditional on the cover being open, and conditional on the unauthorized roll procedure being enabled, activating the indicator to provide indication that an unauthorized sheet product is disposed in the dispenser.

18. The method of claim 10, wherein:

the indicator comprises an LED; and activating the indicator to provide indication that an authorized sheet product is disposed in the dispenser comprises flashing the LED.

19. An electronic sheet product dispenser for dispensing sheet product, the sheet product dispenser comprising:

a support configured to rotatably support a roll of sheet product;

a sensor configured to detect a reference indication on the roll, wherein the reference indication is associated with authorized use of the sheet product in the dispenser;

an indicator configured to provide indication relating to presence of an authorized sheet product disposed in the dispenser;

a feed mechanism comprising a drive motor and at least one roller configured to cooperate to advance the sheet product out of the dispenser;

a manual feed button in operative communication with the feed mechanism to advance the sheet product out of the dispenser in response to the manual feed button being activated; and a processor in operative communication with the sensor, the indicator, the feed mechanism, and the manual feed button, wherein the processor is responsive to executable instructions stored on a storage medium, the executable instructions when executed on the processor for performing a method comprising:

determining whether an authorized sheet product or an unauthorized sheet product is disposed in the dispenser, enabling an authorized roll procedure in response to presence of an authorized sheet product being detected, and enabling an unauthorized roll procedure in response to presence of an unauthorized sheet product being detected; and in response to the manual feed button being activated, and conditional on the authorized roll procedure being enabled, activating the indicator to provide indication that an authorized sheet product is disposed in the dispenser.

20. The dispenser of claim 10, wherein the processor is responsive to executable instructions for performing the method further comprising:

in response to the manual feed button being momentarily activated, activating the feed mechanism to dispense only a single-dispense-portion of sheet product from the dispenser.

21. The dispenser of claim 19, wherein the processor is responsive to executable instructions for performing the method further comprising:

in response to the manual feed button being held activated, activating the feed mechanism to dispense more than a single-dispense-portion of sheet product from the dispenser.

22. The dispenser of claim 21, wherein the processor is responsive to executable instructions for performing the method further comprising:

in response to the manual feed button being held activated, activating the feed mechanism to dispense sheet product from the dispenser until the manual feed button is released.

23. The dispenser of claim 19, further comprising:

a plurality of control switches, each switch having more than one settable position; and wherein the processor is responsive to executable instructions for performing the method further comprising:

in response to the manual feed button being activated for a first time duration, and conditional on the authorized roll procedure being enabled, activating the indicator to provide indication that an authorized sheet product is disposed in the dispenser.

24. The dispenser of claim 23, wherein the processor is responsive to executable instructions for performing the method further comprising:

in response to the manual feed button being activated for a second time duration longer than the first time duration, performing one of a plurality of diagnostic tests relating to the dispenser, wherein the plurality of diagnostic tests have a one-to-one relationship with the combinations of the settable positions of the plurality of control switches.

25. The dispenser of claim 24, wherein:

the plurality of control switches comprises a first switch having three settable positions, a second switch having three settable positions, and a third switch having two settable positions, thereby providing eighteen combinations of the settable positions; and the plurality of diagnostic tests comprises eighteen tests having a one-to-one relationship with the eighteen combinations of the settable positions.

26. The dispenser of claim 19, wherein the indicator is further configured to provide indication relating to presence of an unauthorized sheet product disposed in the dispenser, and wherein the processor is responsive to executable instructions for performing the method further comprising:

in response to the manual feed button being activated, and conditional on the unauthorized roll procedure being enabled, activating the indicator to provide indication that an unauthorized sheet product is disposed in the dispenser.

27. The dispenser of claim 19, wherein the indicator comprises an LED configured to flash to provide indication relating to presence of an authorized sheet product disposed in the dispenser.

* * * * *